US007510255B2

(12) United States Patent
Tamura et al.

(10) Patent No.: US 7,510,255 B2
(45) Date of Patent: Mar. 31, 2009

(54) DEVICE AND METHOD FOR DETECTING TEMPERATURE OF HEAD DRIVER IC FOR INK JET PRINTER

(75) Inventors: Noboru Tamura, Nagano (JP); Yuichi Nishihara, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/231,461

(22) Filed: Aug. 30, 2002

(65) Prior Publication Data

US 2003/0058293 A1 Mar. 27, 2003

(30) Foreign Application Priority Data

Aug. 30, 2001 (JP) ..... 2001-262363
May 29, 2002 (JP) ..... 2002-156080
May 29, 2002 (JP) ..... 2002-156081
May 29, 2002 (JP) ..... 2002-156529

(51) Int. Cl.
*B41J 2/05* (2006.01)

(52) U.S. Cl. ..... 347/17; 347/5; 347/19

(58) Field of Classification Search ..... 347/14, 347/17, 19, 194, 13, 5, 9, 11–12; 713/324
See application file for complete search history.

(56) References Cited

U.S. PATENT DOCUMENTS 5,281,980 A * 1/1994 Kishida et al. ..... 347/13
5,736,995 A * 4/1998 Bohorquez et al. ..... 347/14
5,764,246 A * 6/1998 Wataya et al. ..... 347/14
6,068,363 A * 5/2000 Saito ..... 347/17
6,154,229 A 11/2000 Corrigan
6,270,180 B1 * 8/2001 Arakawa et al. ..... 347/14
6,322,189 B1 * 11/2001 Anderson et al. ..... 347/17
6,435,668 B1 * 8/2002 Barbour et al. ..... 347/19
6,464,318 B2 * 10/2002 Kubo ..... 347/17
6,708,279 B1 * 3/2004 Takenaka ..... 713/324

FOREIGN PATENT DOCUMENTS

JP 03-247457 A 11/1991
JP 04-096267 A 3/1992
JP 4-69741 U 6/1992
JP 08-244231 A 9/1996
JP 09-131879 A 5/1997
JP 11-005324 1/1999
JP 11-129496 5/1999
JP 2000-203061 A 7/2000
JP 2001-058406 A 3/2001

* cited by examiner

*Primary Examiner*—Lam S Nguyen
(74) *Attorney, Agent, or Firm*—Sughrue Mion, PLLC

(57) ABSTRACT

Each of a plurality of driver ICs, which drives an associated print head, includes an analog voltage provider, which provides an analog voltage which is inversely proportional to a temperature of the driver IC, a reference temperature provider, which provides a digital value corresponding to a reference temperature, a D/A converter, which converts the digital value into a corresponding analog value, and a comparator, which compares the analog voltage with the analog value and outputs a comparison signal indicating whether the analog voltage is higher than the analog value. A temperature detector determines whether the temperature of at least one of print heads is higher than the reference temperature in accordance with the comparison signal.

56 Claims, 17 Drawing Sheets

DEVICE AND METHOD FOR DETECTING TEMPERATURE OF HEAD DRIVER IC FOR INK JET PRINTER

BACKGROUND OF THE INVENTION

The invention relates to a technique for detecting that head driver ICs of an ink jet printer have reached a predetermined temperature or higher.

FIG. 1 shows the outline of hardware of an ink jet printer constituted by piezoelectric vibrators serving as elements for ejecting ink from nozzles. As shown in this figure, a controller 102 is a control board which is to be implemented in a printer and causes a print engine 103 to perform printing operation complying with data entered by way of an interface 104. A CPU (central processing unit) 123 executes a program stored in a ROM (read-only memory) 121, thereby controlling individual sections provided in the controller 102. A main bus of the controller 102 is connected to a RAM (random access memory) 122 serving as a primary storage device of the CPU 123 and to a PROM 124 (programmable read-only memory) for recording various types of setting items.

An IC chip 126 provided in the controller 102 actually sends various types of signals to the print engine 103 pursuant to a print instruction construed by the CPU 123. The custom IC chip 126 serves as an engine controller which performs a centralized control operation pertaining to printing and driving of the printer.

First, a signal to be sent from the custom IC chip 126 is a drive signal for controlling a motor. The motor drive signal sent by way of a signal line 128 effects feeding of print paper or actuation of a head unit 131 mounted on an unillustrated carriage.

Signals used directly for printing operation are a digital signal and an analog signal for driving a switcher 135. A digital signal, representing whether ink is ejected from each nozzle, is delivered without modification via a signal line 132 to a switcher 135. A signal to be used for determining the size of ink droplets is temporarily sent to a digital/analog converter 133 in the form of a set of digital vector data through via a signal line 134. The digital signal is converted into an analog trapezoidal waveform, an example of which is shown in FIG. 2, and then delivered to the switcher 135.

In an ink jet printer which causes nozzles to eject ink, by utilization of expanding action of a piezoelectric vibrator 137 shown in FIG. 1, the switcher 135 assumes a configuration such as that shown in FIG. 3.

In FIG. 3, each of the switchers 135 (135-1 through 135-n) has two input ports; that is, a digital input port and an analog input port. An analog drive signal complying with these inputs is output to piezoelectric vibrators 137 (137-1 through 137-n) by way of signal lines 136 (136-1 through 136-n). The digital signal line 132 is connected to an input terminal of the custom IC chip 126 (FIG. 1). Data which have been serially input by way of the custom IC chip 126 are serially transferred to each of shift registers 141 (141-1 through 141-n) in accordance with a clock signal CLK, and latched in each of latches 142 (142-1 through 142-n) at a predetermined timing defined by a latch signal LAT. The thus-latched data are output to the switcher 135.

The switcher 135 outputs to the piezoelectric vibrator 137 an amplitude represented by the analog waveform signal (FIG. 2) at a timing defined by the digital signal. By means of provision of such a switcher for each nozzle, ink droplets of arbitrary size can be ejected at an arbitrary timing. Such switchers equal in number to nozzles are integrated, thereby constituting a single switching semiconductor element.

In a standard assembly process for an ink jet printer, one head is constructed of a total of eight groups of nozzles; that is, a group of black ink nozzles, a group of yellow ink nozzles, a group of cyan ink nozzles, a group of magenta ink nozzles, a group of light cyan ink nozzles, a group of light magenta ink nozzles, and a group of dark yellow ink nozzles. A switching semiconductor element is provided for each of the nozzle groups.

The thus-integrated switcher has a heat resisting temperature at which normal operation of the switcher is guaranteed. Similarly, a heat-resisting temperature is determined also for a conductive adhesive or the like to be used for assembling constituent components of the head. Hence, in order to prevent a hindrance to normal operation of individual constituent components or thermal breakdown of the components, which would otherwise be caused by idle ejecting operation stemming from depletion of ink, a diode which is to serve as a semiconductor element for detecting a temperature is incorporated in each of the ink nozzle drive switching elements. An internal temperature of the semiconductor element is measured by a voltage output from the diode.

FIG. 4 shows a configuration for measuring a temperature, by potential differences among four diodes connected between a constant current source CS and ground. The diodes have physical properties whose output voltages are determined in accordance with a temperature environment when constant power is supplied from the constant current source CS.

An output from the temperature detecting semiconductor element (diode) having such a configuration is returned to the previously-described custom IC chip 26 from the carriage having the printer head unit 131 mounted thereon, by way of a signal line of a flexible flat cable (i.e., the signal line 127 shown in FIG. 1). By utilization of a value of the output, the custom IC chip 26 performs various types of print control operations, such as suspension of a printing operation in the event of generation of, e.g., overheat.

In actual assembly processes relating to manufacture of a printer, a temperature detecting diode has already been incorporated into an ink nozzle drive switching semiconductor element supplied as a component. When the ink nozzle drive switching semiconductor element is produced by way of a single manufacturing process, errors resulting from variations in quality may arise. However, the ink nozzle drive switching semiconductor elements do not vary from each other in terms of principal characteristics; that is, the quantity of heat stemming from switching actions or a characteristic of a voltage changing in accordance with the temperature of a diode.

From the viewpoint of the quantity of supplied parts and costs incurred in material procurement, in many cases parts produced through different manufacturing processes are used in a single printer at a site for controlling manufacturing processes. Even in the case of an ink nozzle drive switching semiconductor element, semiconductor elements produced through different manufacturing processes are employed. In such a case, semiconductor elements supplied from certain manufacturing processes often differ from those supplied from other manufacturing processes in terms of characteristics of diodes built in the semiconductor elements.

FIG. 5 is a graph representing the relationship between characteristics of diodes. In the graph, the vertical axis represents a voltage of an anode output 50 shown in FIG. 4. In other words, the vertical axis corresponds to a total potential difference between the anodes and cathodes of four diodes connected in series with each other. The horizontal axis represents temperatures of locations where a temperature detecting circuit, such as that shown in FIG. 4, is disposed.

The graph shows a physical property of a diode built in a switcher produced through production processes A and that of a diode built in a switcher produced through production processes B, wherein output voltages of the diodes are determined in accordance with a temperature environment. Specifically, a diode produced through manufacturing processes A produces an anode output of 2.4 V in a temperature environment of 25° C., whilst a diode produced through manufacturing processes B produces an anode output of 2.0 V in a temperature environment of 25° C.

Further, the graph also shows a characteristic of a rate at which an output voltage is changed in accordance with changes in a temperature environment; that is, different gradients of respective line segments of the graph.

Variations exist in respective diodes produced through the manufacturing processes A and in those produced through the manufacturing processes B, the variations being attributable to individual differences. In the graph, standard values of products are denoted by solid lines, and the range of variation is denoted by dashed lines.

For instance, in a case where the guaranteed heat-proof temperature of the switcher is 120° C., the switcher is determined to be overheated when the anode output voltage has dropped to 1.3 V (i.e., the maximum value of the individual differences) in light of the temperature-voltage characteristic of the diode produced through the manufacturing processes B. In a case where the temperature of the printer is controlled on the assumption of a characteristic of a rate at which the output voltage of the diode changes, the anode output voltage is considered to have dropped to 2.1 V (i.e., the maximum value of the individual differences) when the ink nozzle driver switching semiconductor element produced through the manufacturing processes A is used for a product. Accordingly, overheat of the switcher cannot be detected.

As mentioned previously, a related-art head driver IC temperature detector of an ink jet printer measures anode voltages of diodes provided in a head driver IC, and the temperatures of junctions of transistors provided in the IC are detected by temperature characteristics of the anode voltages.

However, since diodes have great variations in characteristics thereof, a result of mere measurement of junction temperatures performed by the temperature detecting diodes provided in the head driver IC also includes a great variation.

In short, the above-described temperature detecting method encounters difficulty in detecting temperatures accurately, because of individual differences in anode voltage at a certain temperature or individual differences in temperature coefficient of an anode voltage.

By the way, the head driver ICs generate heat when they are driven, and the heat is dissipated by the ejected ink droplets. However, as a result of uninterrupted operation under extremely high toad, heat dissipation capacity may become insufficient. Moreover, in a state in which ink is not properly squirted for reasons of depletion of ink or clogging of nozzles, sufficient heat dissipation is not achieved. If printing operation is continued in such a state, the temperatures of respective head driver ICs rise further, potentially resulting in thermal destruction of the respective head driver ICs.

Therefore, in a related-art ink jet printer, attention is paid to the anode voltage of a diode provided in each of the head driver ICs changing in accordance with the ambient temperature. As shown in FIG. 6, the anode voltages of the diodes provided in four head driver ICs 1*a*, 1*b*, 1*c*, and 1*d* are output to a controller 4 which is provided in a printer main unit 3 and is constituted of, e.g., an ASIC, by way of respective signal lines 2*a*, 2*b*, 2*c*, and 2*d* provided in a flexible flat cable (FFC).

In the controller 4, the anode voltages are converted into digital values by an analog-to-digital converter 5, thereby detecting anode voltages of diodes of the respective head driver ICs. In accordance with the anode voltages, the temperatures of the respective head driver ICs 1*a*, 1*b*, 1*c*, and 1*d* are detected. When any one of the head driver ICs 1*a*, 1*b*, 1*c*, and 1*d* has reached a predetermined temperature or more, the controller 4 temporarily stops a printing operation, thereby lowering the temperatures of the head driver ICs 1*a*, 1*b*, 1*c*, and 1*d*.

However, according to such a method of detecting the temperatures of the head driver ICs 1*a*, 1*b*, 1*c*, and 1*d*, analog signals pass through the signal lines 2*a*, 2*b*, 2*c*, and 2*d* provided in the comparatively long FFC 7 extending from the printer head 6 to the printer main unit 3. The analog signals are susceptible to the influence of noise, thereby deteriorating the accuracy of detection.

The anode voltages of the respective head drivers ICs 1*a*, 1*b*, 1*c*, and 1*d* are converted into digital signals by the analog-to-digital converter 5 within the controller 4, thereby prolonging a detection time and requiring provision of the analog-to-digital converter 5 within the controller 4. Accordingly, the controller 4 constituted of, e.g., an ASIC, becomes bulky.

Moreover, the lines 2*a*, 2*b*, 2*c*, and 2*d* must be provided in the FFC 7 in equal number with the head drier ICs. Further, the number of input pins of the controller 4 increases, thereby resulting in a cost hike.

In a case where a rupture has arisen in any one of the signal lines, a rise in the temperature of a corresponding head driver IC cannot be detected. Hence, the rise in the temperature of that head driver IC may be left undetected. Accordingly, damage may be inflicted on the printer head.

In this way, when a temperature detecting circuit has become broken as a result of occurrence of a rupture in a signal line or a short-circuit in any one of circuits for detecting temperatures, the configuration shown in FIG. 6 encounters difficulty in immediately detecting the failure and taking a countermeasure, such as suspension of operation of a printer.

SUMMARY OF THE INVENTION

It is therefore a first object of the invention to provide a device for detecting the temperatures of head driver ICs of an ink jet printer in which a configuration is simplified without involvement of the influence of noise.

It is a second object of the invention to provide a device and a method for detecting the temperatures of a plurality of head driver ICs in an ink jet printer, wherein a determination can be made as to which one of the head driver ICs has reached an increased temperature.

It is a third object of the invention to provide a device and a method which enable immediate detection of failures in a circuit for detecting the temperatures of a plurality of head driver ICs in an ink jet printer.

It is a fourth object of the invention to provide a device and a method for detecting temperatures of head driver ICs of an ink jet printer, which enable accurate detection of junction temperatures by highly-accurate correction of variations in the characteristics of diodes to be used for detecting temperatures of head driver ICs.

In order to achieve the above objects, according to the present invention, there is provided an ink jet printer, comprising:

a plurality of driver ICs, each of which drives an associated print head, each driver IC including:

an analog voltage provider, which provides an analog voltage which is inversely proportional to a temperature of the driver IC;

a reference temperature provider, which provides a digital value corresponding to a reference temperature;

a D/A converter, which converts the digital value into a corresponding analog value; and a comparator, which compares the analog voltage with the analog value and outputs a comparison signal indicating whether the analog voltage is higher than the analog value; and a temperature detector, which determines whether the temperature of at least one of print heads is higher than the reference temperature in accordance with the comparison signal.

In this configuration, a digital reference value is set by the reference temperature provider after the ink jet printer is activated. As a result, the D/A converter in each of the head driver ICs converts the digital reference value into an analog reference value, and the analog reference value is input to one of input terminals of the comparator.

In this state, the comparator compares the analog voltage with the analog reference value output from the D/A converter. When the analog voltage is higher than the analog reference value, the comparator renders the digital signal inactive. When the analog voltage has become lower than the analog reference value, the comparator renders the digital signal active.

During the course of a printing operation, the temperature detector can detect that the head driver ICs have become higher than a predetermined temperature, by monitoring digital signals output from comparators provided in the respective head driver ICs. Further, as mentioned previously, when the head driver ICs have been detected as having reached a temperature higher than a predetermined temperature, the temperature detector temporarily suspends printing operation or, in some cases, forcefully terminates printing operation, thereby preventing thermal destruction of the head driver ICs, which would otherwise be caused by a temperature increase.

Accordingly, signals which are output from the respective head driver ICs to the temperature detector are digital signals. Hence, even when a cable linking a head driver IC to the controller is long, the signal carried thereby is less susceptible to the influence of noise, whereby the accuracy of detection is improved. Since the temperature detector does not need an A/D converter, only a short period of detecting time is required. Even during a short period of time, such as a period of printing operation, temperatures of the head driver ICs can be detected surely.

Preferably, the comparison signal from each of the driver ICs is inputted to the temperature detector independently from another.

In this configuration, digital signals output from comparators of respective head driver ICs are independently output to the controller of the printer main unit. Even when a fault, such as a rupture, has arisen in a portion of cables which link the respective head driver ICs to the temperature detector, a temperature of only the head driver IC using the cable in which the fault has arisen fails to be detected, and temperatures of the head driver ICs using the remaining cables can be detected.

Preferably, the driver IC includes an FET in which the comparison signal is inputted to a gate and a drain is left open.

In this configuration, the FETs are turned on or off, by the digital signals output from the respective comparators, and outputs from the open drains are input into the temperature detector.

Here, it is preferable that a digital output signal from the FET in each of the driver ICs is inputted to the temperature detector independently from another.

In this configuration, digital signals output from the FETs of the respective head driver ICs are independently output to the temperature detector. Hence, even when a fault, such as a rupture, has arisen in a portion of the cable which links the respective driver ICs to the printer main unit, a temperature of only the head driver IC using a cable in which the fault has arisen fails to be detected, and temperatures of the head driver ICs using the remaining cables can be detected.

Alternatively, it is preferable that an output terminal of the FET in each of the driver ICs is wired-AND connected with another output terminals so that a digital output signal from each FET is transmitted to the temperature detector via a single line.

In this configuration, digital signals output from the FETs of the respective head driver ICs are output by open drains. Hence, even when outputs of open drains of the respective FETs are connected together in the form of a wired-AND configuration, digital signals output from the respective FETs are output to the temperature detector by way of a single cable without involvement of occurrence of interference.

Accordingly, only a single cable is required for detecting the temperatures of a plurality of head driver ICs. Hence, costs are curtailed, and only a few input pins of the temperature detector are required. Hence, the invention can contribute to a reduction in the number of pins of an ASIC constituting the temperature detector (controller).

Preferably, the driver IC includes a bipolar transistor in which the comparison signal is inputted to a base and a collector is left open.

In this configuration, the bipolar transistors are turned on or off by digital signals output from the respective comparators, and outputs of open collectors are input to the temperature detector.

Here, it is preferable that a digital output signal from the bipolar transistor in each of the driver ICs is inputted to the temperature detector independently from another.

In this configuration, digital signals output from the bipolar transistors of the respective head driver ICs are independently output to the temperature detector. Hence, even when a fault, such as a rupture, has arisen in a portion of the cable which links the respective driver ICs to the temperature detector, a temperature of only the head driver IC using a cable in which the fault has arisen fails to be detected, and temperatures of the head driver ICs using the remaining cables can be detected.

Alternatively, it is preferable that an output terminal of the bipolar transistor in each of the driver ICs is wired-AND connected with another output terminals so that a digital output signal from each bipolar transistor is transmitted to the temperature detector via a single line.

In this configuration, digital signals output from the bipolar transistors of the respective head driver ICs are output by open collectors. Hence, even when outputs of open collectors of the respective bipolar transistors are connected together in the form of a wired-AND configuration, digital signals output from the respective bipolar transistors are output to the temperature detector by way of a single cable without involvement of occurrence of interference.

Accordingly, only one cable is required for detecting the temperatures of a plurality of head driver ICs. Hence, costs are curtailed, and only a few input pins of the controller of the temperature detector are required. Hence, the invention can contribute to a reduction in the number of pins of an ASIC constituting the temperature detector (controller).

Preferably, the reference temperature is determined for each driver IC in accordance with a placement condition of the driver IC.

In this configuration, the digital reference values of the reference temperature providers of the respective head driver ICs can be set in accordance with individual conditions of the respective head driver ICs and variations in the characteristics of diodes provided in the head driver ICs.

Preferably, a digital data storage composed of a predetermined number of bit which defines an adjustable range of the digital value.

In this configuration, a printer designer can freely set the digital reference value within the range of bits by reference to individual conditions ascertained through preliminary measurement of each head driver IC.

Preferably, the temperature detector determines that a fatal error occurs in the printer when a number of determination that the temperature of the print head is higher than the reference temperature exceeds a predetermined number.

Preferably, the ink jet printer further comprises a selector, which selectably varies the digital value of at least one reference temperature provider. Here, the selector varies the digital value of each reference temperature provider in accordance with a predetermined order, when the comparison signal indicates that the temperature of at least one print head is higher than the reference temperature. The temperature detector determines that the temperature of one drive IC is higher than the reference temperature when the comparison signal changes in accordance with the variation of the digital signal of the one drive IC.

More specifically, the digital reference values of respective head driver ICs are varied one after another. For instance, the selector minimizes the digital value. The head driver IC whose comparison signal has been changed is specified as a head driver IC whose temperature has increased above or decreased below the reference temperature.

Alternatively, in an ink jet printer having, e.g., eight head driver ICs, digital reference values (threshold values) of four head driver ICs are preferably switched simultaneously; then digital reference values (threshold values) of two head driver ICs are preferably switched simultaneously; and then a digital reference value (threshold value) of one head driver IC is preferably switched, so as to avoiding switching of digital reference value (threshold value) eight times. In this way, a head driver IC whose temperature has increased above or decreased below the reference value can be specified by only three switching operations.

Preferably, the ink jet printer further comprises:

a thermistor, provided on each print head to detect an ambient temperature of the print head; and a corrector, which corrects the temperature of each print head detected based on the analog voltage, by using the ambient temperature detected by the thermistor.

Here, it is preferable that the ink jet printer further comprises:

a first calculator, which calculates a theoretical temperature dependency of the analog voltage when the print head is driven in a predetermined manner; and a second calculator, which calculates an actual temperature dependency of the analog voltage when the print head is driven in the predetermined manner.

The corrector corrects the detected temperature of each print head based on a difference between the theoretical temperature dependency and the actual temperature dependency.

Further, it is preferable that the thermistor detects a first ambient temperature at an initial condition and a second ambient temperature when the print head is driven such an extent that no ink drop is ejected from the nozzle array. The actual temperature dependency of the analog voltage is determined by measuring a difference between a first analog voltage at the first ambient temperature and a second analog voltage at the second ambient temperature.

According to the present invention, there is also provided an ink jet printer, comprising:

a plurality of driver ICs, each of which drives an associated print head, each driver IC including a diode, which provides an anode voltage which is inversely proportional to a temperature of the driver IC;

a thermistor, provided on each print head to detect an ambient temperature of the print head; and a corrector, which corrects the temperature of each print head detected based on the anode voltage, by using the ambient temperature detected by the thermistor.

Namely, the invention can also be applied to an ink jet printer in which an analog signal corresponding to an anode voltage of the diode is outputted via a signal line, and converting the analog signal into a digital signal through use of the controller of the printer main unit.

Here, it is preferable that the ink jet printer further comprises:

a first calculator, which calculates a theoretical temperature dependency of the anode voltage when the print head is driven in a predetermined manner; and a second calculator, which calculates an actual temperature dependency of the anode voltage when the print head is driven in the predetermined manner.

The corrector corrects the detected temperature of each print head based on a difference between the theoretical temperature dependency and the actual temperature dependency.

Further, it is preferable that the thermistor detects a first ambient temperature at an initial condition and a second ambient temperature when the print head is driven such an extent that no ink drop is ejected from the nozzle array. The actual temperature dependency of the anode voltage is determined by measuring a difference between a first anode voltage at the first ambient temperature and a second anode voltage at the second ambient temperature.

These correction are performed preferably at the time of assembly of an ink jet printer, at the time of first activation of the printer after a user has purchased the printer, or every time the printer is activated.

The anode voltage is subjected to the A/D conversion, and a junction temperature is determined by use of the temperature dependency of the anode voltage determined above. The upper limit anode voltage of the junction temperature is determined from the thus-determined dependency. A protection measure, such as interruption of printing operation, is taken when the anode voltage has achieved the value.

As mentioned above, the anode voltage is corrected by matching the result of temperature detected by the thermistor provided on the print head with the temperature corresponding to the anode voltage. Hence, the junction temperatures of the head driver ICs can be detected accurately.

According to the present invention, there is also provided an ink jet printer, comprising:

a plurality of driver ICs, each of which drives an associated print head, each driver IC including:

an analog voltage provider, which provides an analog voltage which is inversely proportional to a temperature of the driver IC;

a reference temperature provider, which provides a digital value corresponding to a reference temperature;

a D/A converter, which converts the digital value into a corresponding analog value; and a comparator, which compares the analog voltage with the analog value and outputs a comparison signal indicating whether the analog voltage is higher than the analog value;

a digital data storage, composed of a predetermined number of bit which defines an adjustable range of the digital value;

a selector, which selectably changes the digital value of each reference temperature provider; and a failure detector, which determines that whether at least one of the driver ICs is in a failure, wherein:

the selector selectively varies the digital value of each reference temperature provider in accordance with a predetermined order at a predetermined timing; and the failure detector determines that one drive IC is in a failure when the comparison signal changes in accordance with the variation of the digital signal of the one drive IC.

Preferably, the selector maximizes the digital value.

Preferably, the selector varies the digital value periodically.

For instance, the predetermined timing is at least one of when the printer is activated, when a printing operation is sustained, when a page break is performed.

If the comparison signals are not changed, occurrence of a rupture in the FFC is suspected. The failure detector determines that there is a failure common to the respective driver ICs when it is determined that all the driver ICs are in a failure.

Preferably, the ink jet printer further comprises a temperature detector, which determines whether the temperature of at least one of print heads is higher than the reference temperature in accordance with the comparison signal. The selector minimizes the digital values of all the driver ICs collectively, when the comparison signal indicates that the temperature of at least one print head is higher than the reference temperature. The failure detector determines that at least one of the driver ICs is in a failure when the comparison signal changes in accordance with the minimization.

In this configuration, occurrence of a failure can be detected immediately.

According to the present invention, there is also provided a temperature detecting method for an ink jet printer provided with a plurality of driver ICs, each of which drives an associated print head, the method comprising the steps of:

a) providing a digital value corresponding to a reference temperature;

b) converting the digital value into a corresponding analog value;

c) comparing an analog voltage, which is inversely proportional to a temperature of the driver IC, with the analog value;

d) generating a comparison signal indicating whether the analog voltage is higher than the analog value; and e) determining whether the temperature of at least one of print heads is higher than the reference temperature in accordance with the comparison signal, wherein the steps a) to d) are performed in each driver IC.

Preferably, the reference temperature is determined for each driver IC in accordance with a placement condition of the driver IC.

Preferably, the temperature detecting method further comprises the step of determining that a fatal error occurs in the printer when a number of determination that the temperature of the print head is higher than the reference temperature exceeds a predetermined number.

Preferably, the temperature detecting method further comprises the steps of:

varying selectively the digital value of at least one driver IC in accordance with a predetermined order, when the comparison signal indicates that the temperature of at least one print head is higher than the reference temperature; and determining that the temperature of one drive IC is higher than the reference temperature when the comparison signal changes in accordance with the variation of the digital signal of the one drive IC.

Here, it is preferable that the digital data is minimized in an adjustable range thereof.

Preferably, the temperature detecting method further comprises the steps of:

minimizing collectively the digital values of all the driver ICs in adjustable ranges thereof, when the comparison signal indicates that the temperature of at least one print head is higher than the reference temperature; and determining that at least one of the driver ICs is in a failure when the comparison signal changes in accordance with the minimization.

Preferably, the temperature detecting method further comprises the steps of:

detecting an ambient temperature of the print head; and correcting the temperature of each print head detected based on the analog voltage, by using the detected ambient temperature.

Here, it is preferable that the temperature detecting method further comprises the steps of:

calculating a theoretical temperature dependency of the analog voltage when the print head is driven in a predetermined manner; and calculating an actual temperature dependency of the analog voltage when the print head is driven in the predetermined manner.

The detected temperature of each print head is corrected based on a difference between the theoretical temperature dependency and the actual temperature dependency.

Further, it is preferable that the ambient temperature detecting step including: detecting a first ambient temperature at an initial condition; and detecting a second ambient temperature when the print head is driven such an extent that no ink drop is ejected from the nozzle array. The actual temperature dependency of the analog voltage is determined by measuring a difference between a first analog voltage at the first ambient temperature and a second analog voltage at the second ambient temperature.

According to the present invention, there is also provided a temperature detecting method for an ink jet printer provided with a plurality of driver ICs, each of which drives an associated print head, the method comprising the steps of:

detecting an ambient temperature of each print head; and correcting the temperature of each print head detected based on an anode voltage of a diode provided in each of the driver ICs, by using the detected ambient temperature.

Here, it is preferable that the temperature detecting method further comprises the steps of:

calculating a theoretical temperature dependency of the anode voltage when the print head is driven in a predetermined manner; and calculating an actual temperature dependency of the anode voltage when the print head is driven in the predetermined manner.

The detected temperature of each print head is corrected based on a difference between the theoretical temperature dependency and the actual temperature dependency.

Further, it is preferable that the ambient temperature detecting step including: detecting a first ambient temperature at an initial condition; and detecting a second ambient temperature when the print head is driven such an extent that no ink drop is ejected from the nozzle array. The actual temperature dependency of the anode voltage is determined by measuring a difference between a first anode voltage at the first ambient temperature and a second anode voltage at the second ambient temperature.

According to the present invention, there is also provided a failure detecting method for an ink jet printer provided with a plurality of driver ICs, each of which drives an associated print head, the method comprising the steps of:

providing a digital value corresponding to a reference temperature;

converting the digital value into a corresponding analog value;

comparing an analog voltage, which is inversely proportional to a temperature of the driver IC, with the analog value;

generating a comparison signal indicating whether the analog voltage is higher than the analog value;

determining whether the temperature of at least one of print heads is higher than the reference temperature in accordance with the comparison signal;

varying selectively the digital value of at least one driver IC in accordance with a predetermined order at a predetermined timing; and determining that one drive IC is in a failure when the comparison signal changes in accordance with the variation of the digital signal of the one drive IC.

Preferably, the digital value is maximized in an adjustable range thereof.

Preferably, the predetermined timing is at least one of when the printer is activated, when a printing operation is sustained, when a page break is performed.

Preferably, the selector varies the digital value periodically.

Preferably, the failure detector determines that there is a failure common to the respective driver ICs when it is determined that all the driver ICs are in a failure.

Preferably, the failure detection method further comprises the steps of:

determining whether the temperature of at least one of print heads is higher than the reference temperature in accordance with the comparison signal;

minimizing the digital values of all the driver ICs collectively, when the comparison signal indicates that the temperature of at least one print head is higher than the reference temperature; and determining that at least one of the driver ICs is in a failure when the comparison signal changes in accordance with the minimization.

According to the present invention, there is also provided a computer-readable recording medium, which causes a computer to execute the above temperature detecting methods and the failure detecting methods.

According to the present invention, there is also provided a computer program, which causes a computer to execute the above temperature detecting methods and the failure detecting methods.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

Embodiments of a head driver IC equipped with a device for detecting temperatures of head driver ICs (hereinafter often simply called a "head driver IC temperature detector") according to the invention will now be described with reference to the accompanying drawings. The embodiments to be described below are specific, preferable examples of the invention. Hence, various technically-preferable limitations are imposed on the specific examples. However, unless otherwise specified, the scope of the invention is not limited to the embodiments.

Figure 7:
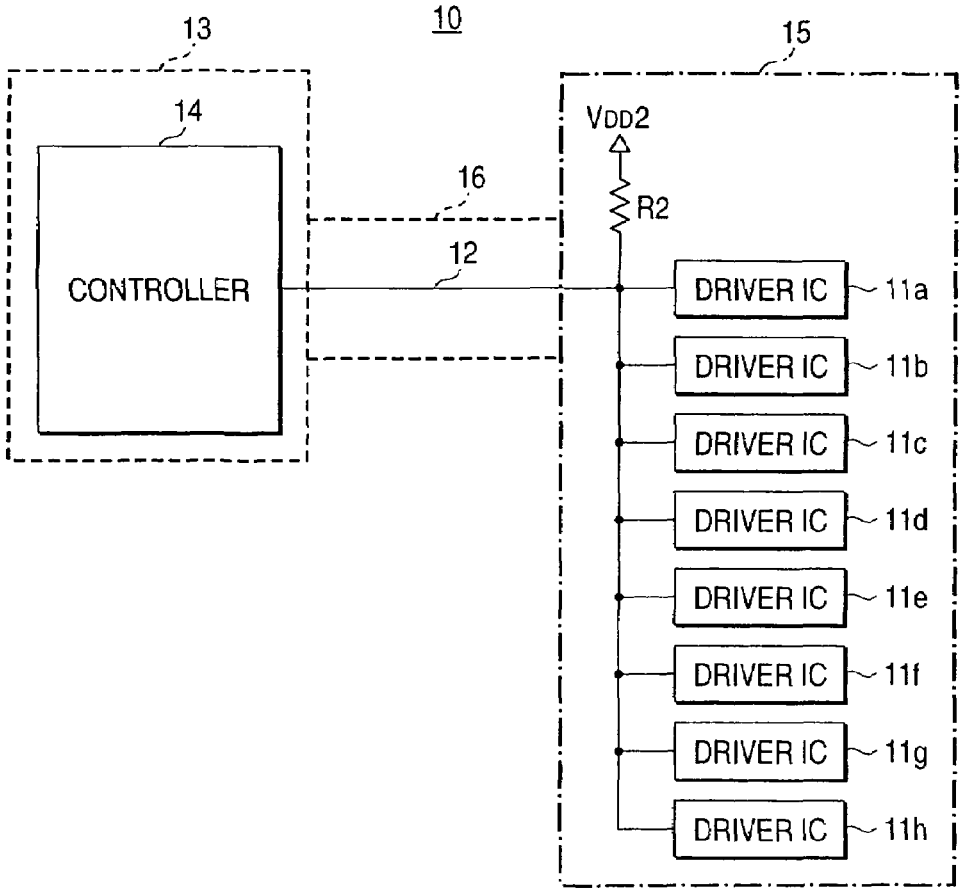
FIG. 7 is a block diagram showing the configuration of a head driver IC temperature detector according to a first embodiment of the invention.

FIG. 7 shows the configuration of a head driver IC temperature detector according to a first embodiment of the invention. An ink jet printer having the head driver IC temperature detector of the embodiment is a seven-color printer comprising: cyan (C), magenta (M), yellow (Y), black (K), light cyan (LC), light magenta (LM), and dark yellow (DY). The printer has a printer head comprising a total of eight rows of nozzles; namely, a row of cyan nozzles, a row of magenta nozzles, a row of yellow nozzles, two rows of black nozzles, a row of light-cyan nozzles, a row of light-magenta nozzles, and a row of dark-yellow nozzles.

The head driver IC temperature detector according to the embodiment is configured in a printer head 15 of the ink jet printer such that anode voltages of diodes provided in a plurality of head driver ICs 11*a*, 11*b*, 11*c*, 11*d*, 11*e*, 11*f*, 11*g*, and 11*h* (eight driver ICs) disposed for respective rows of nozzles are compared with the reference voltage. A result of comparison is digitized, and the thus-digitized result is output to a controller 14 provided in a printer main unit 13.

Here, the head driver ICs 11*a* through 11*h* are of the same configuration, and are ICs (integrated circuits) each constituting a transmission gate for activating or deactivating a switching circuit which controls ejection of ink from a plurality of rows of nozzles provided in a total of eight rows of nozzles.

Figure 8:
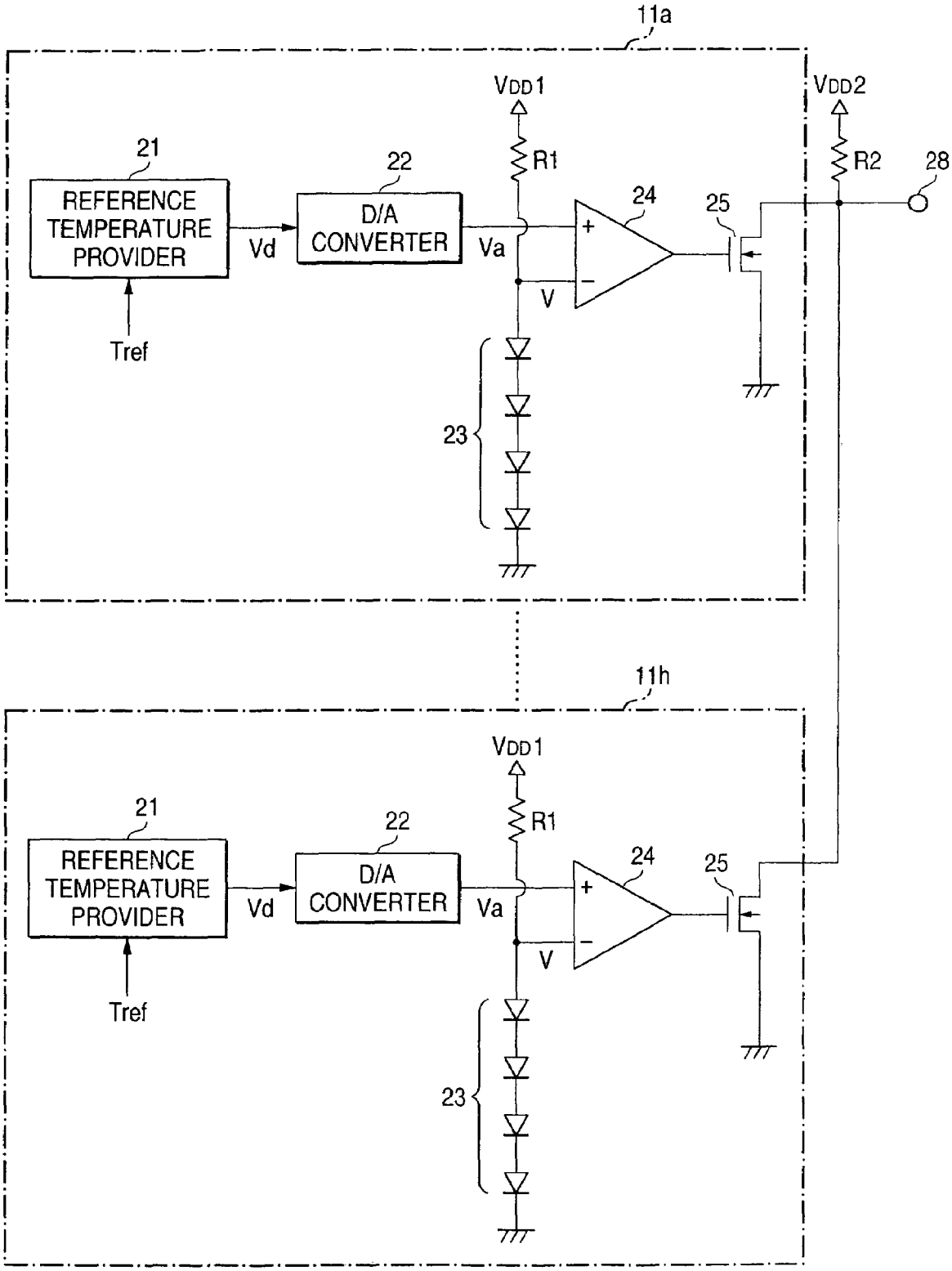
FIG. 8 is a block diagram showing the principal section of each of the head driver ICs in the head driver IC temperature detector shown in FIG. 7.

FIG. 8 is a block diagram showing the configuration of a portion related to detecting of temperatures of the head driver ICs 11*a* through 11*h*. Each of the head driver ICs 11*a* through 11*h* includes a reference temperature provider 21, a digital-to-analog converter 22, a diode 23, a comparator 24, and an FET 25.

The reference temperature provider 21 is constituted of, e.g., a register or the like, and sets a digital reference value Vd corresponding to a reference temperature Tref for detecting a temperature. The digital-to-analog converter 22 converts the digital reference value Vd output from the reference temperature provider 21 into an analog reference value Va. The diode 23 is provided in the head driver IC 11*a*, and the anode of the diode 23 is connected to a constant voltage source Vdd1 via a resistor R1. Further, the cathode of the diode 23 is connected to ground.

In the illustrated case, the diode 23 is constructed by serial connection of a plurality of diodes (e.g., four diodes). Here, as will be described later, the anode voltage of the diode 23 has the characteristic of dropping as the temperature of the head driver IC rises.

An anode voltage V of the diode 23 is input to an inverted input terminal of the comparator 24, and an analog reference value Va output from the digital-to-analog converter 22 is input into a non-inverted input terminal of the same. Then, the comparator 24 compares the anode voltage V is compared with the analog reference value Va. When the anode value V of the diode 23 is higher than the analog reference value Va, the comparator 24 outputs a low-level digital signal. When the anode voltage V of the diode 23 has become lower than the analog reference value Va, the comparator 24 outputs a high-level digital signal.

The gate of the FET 25 is connected to an output terminal of the comparator 24, and the source of the same is connected to ground. The drain of the FET 25 is connected to a constant voltage source Vdd2 via a resistor R2. A digital signal is output from a drain, which is an open drain. As a result, when the signal output from the comparator 24 is at a low level, the FET 25 remains inactive. The drain of the FET is held at the voltage of the constant voltage source Vdd2 (i.e., a high level). When the signal output from the comparator 24 has become high, the FET 25 becomes active, and the drain thereof is dropped to the ground potential (i.e., a low level).

Respective temperature detecting sections of the head driver ICs 11*a* through 11*h* constituted in the manner set forth are connected to the output terminal 28 shared among outputs from the open drains of the respective FETs 25, in the form of a wired-AND configuration. Accordingly, when temperature detecting outputs from all the head driver ICs 11*a* through 11*h* are held at the voltage of the constant voltage supply Vdd2 (i.e., a high level), a temperature detecting signal XHOT output from the output terminal 28 remains at a high level. In contrast, when any one of temperature detecting outputs from the head driver ICs 11*a* through 11*h* has dropped to a ground potential (a low level), the temperature detecting signal XHOT output from the output terminal 28 becomes low. Alternatively, the output terminals of the open drains of the respective FETs 25 may be connected to the common output terminal 28 in the form of a wired-OR configuration such that, when any one of the temperature detecting outputs from the head driver ICs 11*a* through 11*h* has dropped to the ground potential (a low level), the temperature detecting signal XHOT output from the output terminal 28 becomes low.

Figure 9:
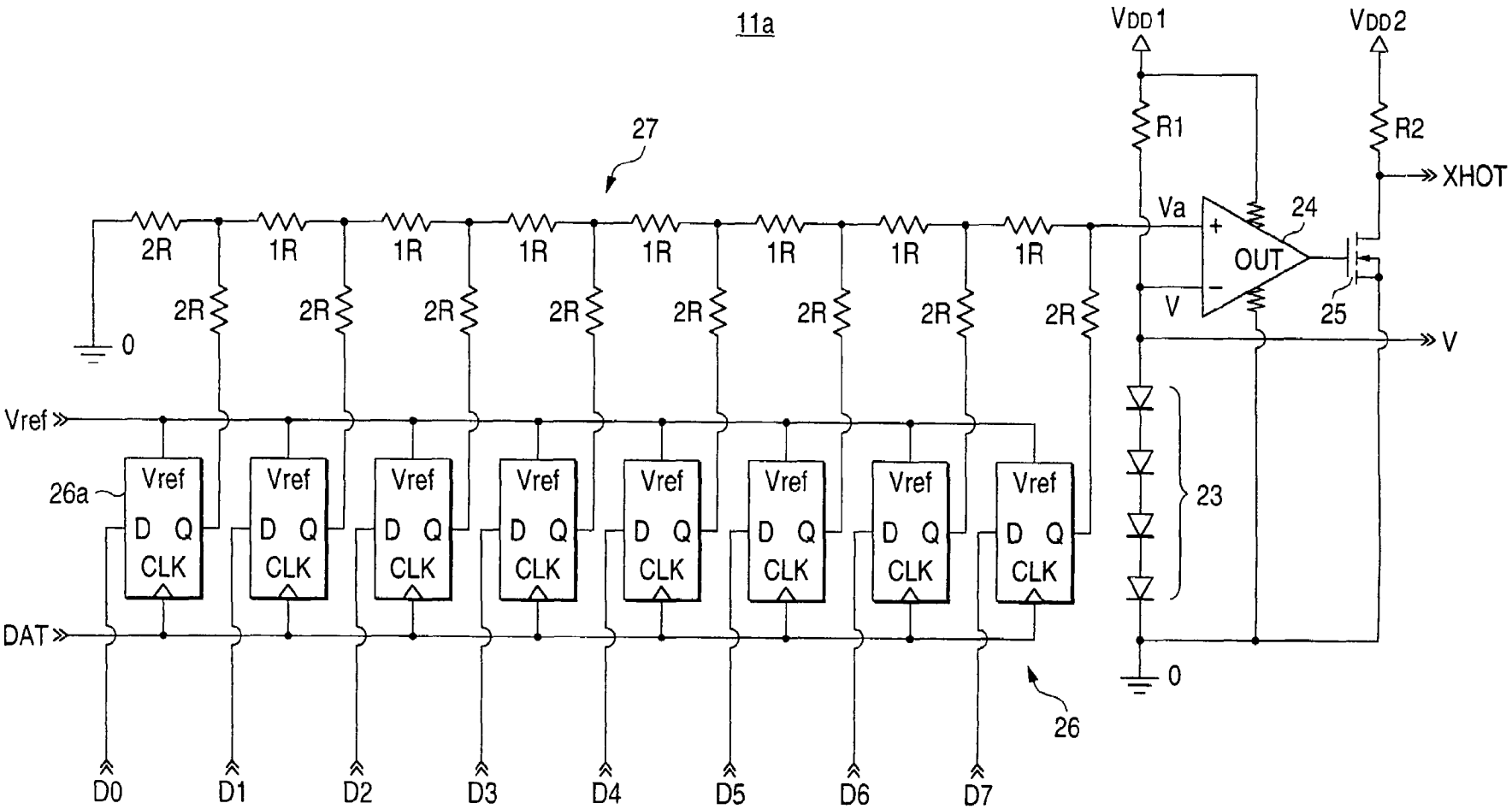
FIG. 9 is a view showing a specific example configuration of the principal section of each of the head driver ICs shown in FIG. 8.

FIG. 9 shows a specific example configuration of the head driver IC 11*a*. The head driver IC 11*a* is identical in configuration with that shown in FIG. 8. In place of the reference temperature provider 21 and the digital-to-analog converter 22, the head driver IC 11*a* comprises a plurality of flip-flop circuits 26 and a group of resistors 27.

In the case shown in the illustration, the flip-flop circuit 26 is constituted of eight flip-flop circuits 26*a*. A latch signal is input to a clock terminal CLK of each of the flip-flop circuits 26*a*, and a setting signal is input to a terminal D of each flip-flop circuit 26*a*. A reference voltage Vref is input to a Vref terminal of the flip-flop circuit 26*a*.

When flip-flops are set to a high level, they output a reference voltage Vref. When the flip-flops are set to a low level, they output a ground potential GND. Data to be used for selecting a nozzle (data to be used for activating or deactivating a switching circuit for controlling the ejection of ink from a plurality of nozzles provided in respective nozzle rows) are serially sent to the head driver IC. However, the data are preferably used as inputs D0 through D7 to be delivered to terminals D. In this case, serial data are input to the shift register. For instance, the finally-sent data are taken as D0 through D7, and a latch signal LAT to be used specifically with a temperature detection circuit is used, whereby data are stored in the flip-flop.

The group of resistors 27 comprises seven resistors 1R and one resistor 2R, which are serially connected between a non-inverted input terminal and ground of the comparator 24, and eight resistor 2R connected between the anodes of the respective resistors 1R and output terminals Q of the respective flip-flop circuits 26*a*.

As a result, the analog reference value Va to be input to the non-inverted input terminal of the comparator 24 is set in 256 steps from a voltage of 0 to a voltage slightly lower than the reference voltage Vref, by combination of the setting signals to be input to the terminals D of the respective flip-flop circuits 26*a*.

The analog reference value Va to be input to the non-inverted input terminal of the comparator 24 is set for respective head driver ICs 11*a* through 11*d* prior to shipment, in consideration of variations in the characteristics of the diodes 23 to be incorporated into the head drivers ICs 11*a* through 11*d* such that the analog reference value Va corresponds to an upper limit temperature T2 set so as to become slightly lower than the guaranteed temperature T1 of each of the head drivers ICs 11*a* through 11*d*.

The temperature detector 10 of the embodiment is operated in the following manner. First, setting of the analog reference value Va will be described.

Figure 10:
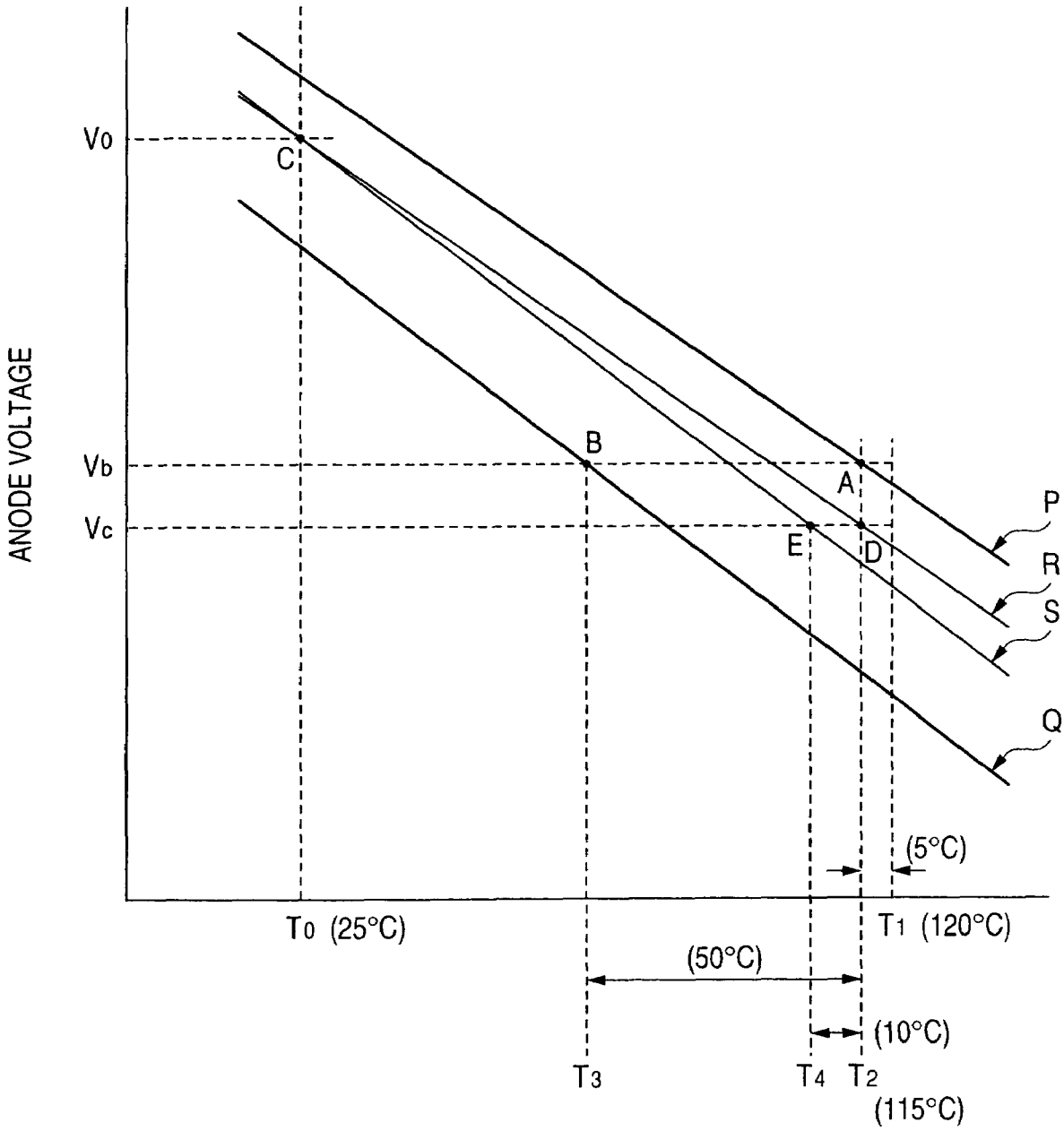
FIG. 10 is a graph showing procedures for setting analog reference values of the head driver IC temperature detector shown in FIG. 7.

As shown in FIG. 10, the diodes 23 to be incorporated into the respective head drivers ICs 11*a* through 11*d* each have a temperature voltage characteristic falling within the range defined between straight lines P and Q. Variations in characteristics include inclination variations and offset variations, of which the inclination variations impose greater adverse influence on the diodes. The offset variations can be corrected by measuring voltages at a certain temperature at the time of shipment from a factory.

First, consideration is given of a case where initial measurement is not performed. Each of the diodes 23 has a characteristic falling within the range defined between the straight lines P and Q. A voltage Vb defines a point of intersection A between the straight line P showing the upper limit characteristic and an upper limit temperature T2 which is slightly lower than the guaranteed temperature T1 of the head driver IC by a predetermined margin. While the voltage Vb is taken as a threshold value for the anode voltage of the diode when the diode is not subjected to initial measurement, a point of intersection B between the voltage Vb and the straight line Q of the threshold value is determined (i.e., a temperature T3 and the voltage Vb are determined).

In this way, when the diode 23 is not subjected to initial measurement, the threshold value Vb of the anode voltage set in consideration of variations in the characteristic of each diode 23 falls within a temperature range defined between the points A and B; namely, a temperature range of T2 to T3.

For this reason, depending on variations in the characteristic of the diode 23, a rise in the temperature of the head driver IC is detected even at a temperature T3 which is considerably lower than the upper limit temperature T2.

In contrast, when the anode voltage of the diode 23 is actually measured at room temperature T0, the thus-measured anode voltage is taken as a measured voltage V0. As shown in FIG. 10, a point C is plotted on a temperature-voltage graph. A straight line R is drawn from the point C so as to become parallel with the straight line P (having a negative gradient) which represents upper limits imposed on inclination variations and has a gentle gradient, thereby determining a point of intersection D (a temperature T2, a voltage Vc) between the straight line R and the upper limit temperature T2.

At this time, a straight line S is drawn from the point C so as to become parallel with the straight line Q which represents a lower limit on inclination variations and has a steep gradient, thereby determining a point of intersection E (a temperature T4, and a voltage Vc) between the straight line S and the voltage Vc. In this case, when the diode 23 is subjected to initial measurement, the threshold value of the anode voltage at the point of intersection D falls within the temperature range defined between the points of intersection D and E; namely, a comparatively narrow temperature range defined between T4 through T2, thereby improving the accuracy of detection of a temperature.

In this way, when the threshold value Vc (=analog reference value Va) of the anode voltage of the diode 23 has been determined, a digital reference value Vd (e.g., represented as "01001100") corresponding to the analog reference value Va is determined. Hence, the digital reference value Vd is input to the reference temperature provider 21. As a result, the accuracy of detection of a temperature is improved by absorbing variations in the characteristics of the respective diodes 23.

The temperature detecting operation of the temperature detector 10 will now be described. When power of the ink jet printer has been turned on, the digital reference value Vd stored in a non-volatile RAM, the value having been set beforehand in the factory through initial measurement, is set, as an initialization operation, beforehand in the respective voltage setting providers 21 within the head driver ICs 11*a* through 11*d*. The digital-to-analog converter 22 converts the digital reference value Vd into an analog reference value Va, and the thus-converted value is input to the non-inverted input terminals of the respective comparators 24.

Meanwhile, anode voltages V corresponding to the temperatures of the head driver ICs 11*a* through 11*d* develop in the diodes 23. As a result, each of the comparators 24 compares the analog reference value Va with the anode voltage V. When the anode voltage V is higher than the reference value Va, the comparator 24 outputs a low-level signal. The FET 25 remains inactive, and a voltage supplied from the constant voltage source Vdd2 is applied to the output terminal 28. Consequently, the temperature detecting signal XHOT output from the output terminal 28 connected in the form of a wired-AND configuration becomes high.

As a result, the temperature of any one of the head driver ICs 11*a* through 11*d* rises in association with printing operation, and the anode voltage V of the diode 23 drops to a level lower than the analog reference value Va, whereby the comparator 24 outputs a high-level signal. As a result, the FET 25 is turned on, and the drain of the FET 25 is dropped to the ground potential. Consequently, the temperature detecting signal XHOT output from the output terminal 28 connected in the form of a wired-AND configuration drops to a low level.

In this way, when the temperature of any one of the head driver ICs 11*a* through 11*d* has a chance of exceeding the upper limit temperature T2 (the temperatures may be lower than T2 for reasons of inclination variations but are higher than T4), an output of the comparator becomes high. The digital signal which is output from the output terminal 28 connected in the form of a wired-AND configuration by the open drain of the FET 25 and input into the controller 14 by a single signal line 12 provided in the FFC 16 changes from a high level to a low level. Thus, the chance of the temperature of the head driver IC of the controller 14 having exceeded the upper limit temperature T2 can be detected.

In this case, a digital signal is input to the controller 14 from each of the head driver ICs 11*a* through 11*d* by way of a single cable 12 provided in the FFC 16. Hence, analog-to-digital conversion of an anode voltage output from the diode 23, which has hitherto been performed, is not required. Hence, provision of an analog-to-digital converter in the controller 14 is obviated. Further, there may also be obviated a necessity for providing signal lines in the FFC 16 for the respective head driver ICs 11*a* through 11*d*. Accordingly, the controller 14 can be made compact with fewer pins. Further, a line used for temperature detecting may also be embodied by use of a one-core cable to be provided in the FFC 16, thereby enabling cost reduction.

Figure 11:
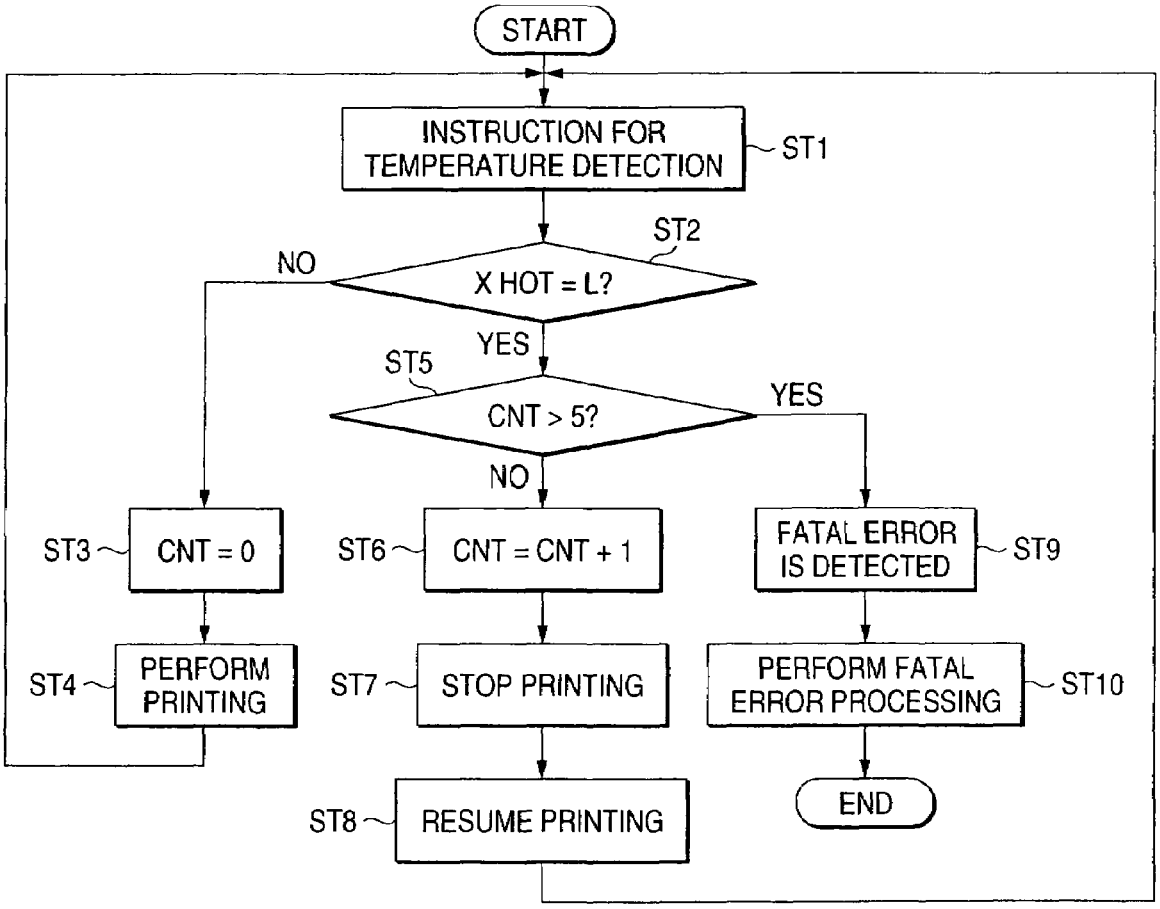
FIG. 11 is a flowchart showing example control of the controller in the head drive IC temperature detector shown in FIG. 7.

As a result of input of a digital signal for temperature detection from the head driver IC, the controller 14 operates in such a manner as shown in, e.g., FIG. 11. In connection with a flowchart shown in this figure, in step ST1 the controller 14 outputs an instruction for detecting a temperature to each of the head driver ICs 11*a*. An instruction for detecting a temperature is output at a point in time when printing operation to be performed on, e.g., a per-page basis or per-line basis, is completed.

In step ST2, when a digital signal XHOT input from each of the head driver ICs 11*a* through 11*d* by way of the cable 12 is high, all the head driver ICs 11*a* through 11*d* fall below the upper limit temperature T2. In step ST3, the controller 14 assumes a count CNT=0 (here, CNT denotes a variable showing the number of consecutive times the digital signal XHOT has become low). In step ST4, printing operation is continued, and processing returns to ST1.

When the digital signal XHOT is at a low level in step ST2, the controller 14 checks a count CNT in step ST5. When CNT≦5, a count is incremented to a count CNT=CNT+1 in step ST6. After a printing operation has been suspended for a predetermined period of time in step ST7, a printing operation is resumed in step ST8. Processing returns to step ST1. A down time required in step ST7 may be set so as to become constant or so as to become longer with an increase in the value of the count CNT.

When CNT>5 is determined in step ST5, the controller 14 determines occurrence of a fatal error in step ST9. In step ST10, there is performed fatal error processing including forcible termination of printing operation, thereby deactivating the ink jet printer. The processing is then finished.

Figure 12:
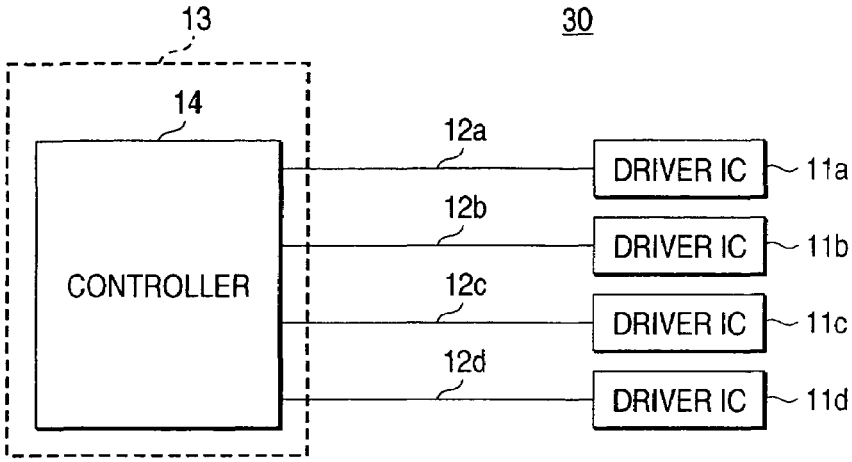
FIG. 12 is a block diagram showing the configuration of a head driver IC temperature detector according to a second embodiment of the invention.

FIG. 12 shows a second embodiment of a head driver IC temperature detector of the invention. As shown in FIG. 12, a head driver IC temperature detector 30 is identical in construction with that shown in FIG. 7, and they differ from each other in only the following points.

More specifically, in the head driver IC temperature detector 30, the signals for temperature detection output from the respective head drivers ICs 11*a* through 11*d* are input to the controller 14 of the printer main unit 13 by way of the mutually-independent cables 12*a*, 12*b*, 12*c*, and 12*d*.

Figure 1:
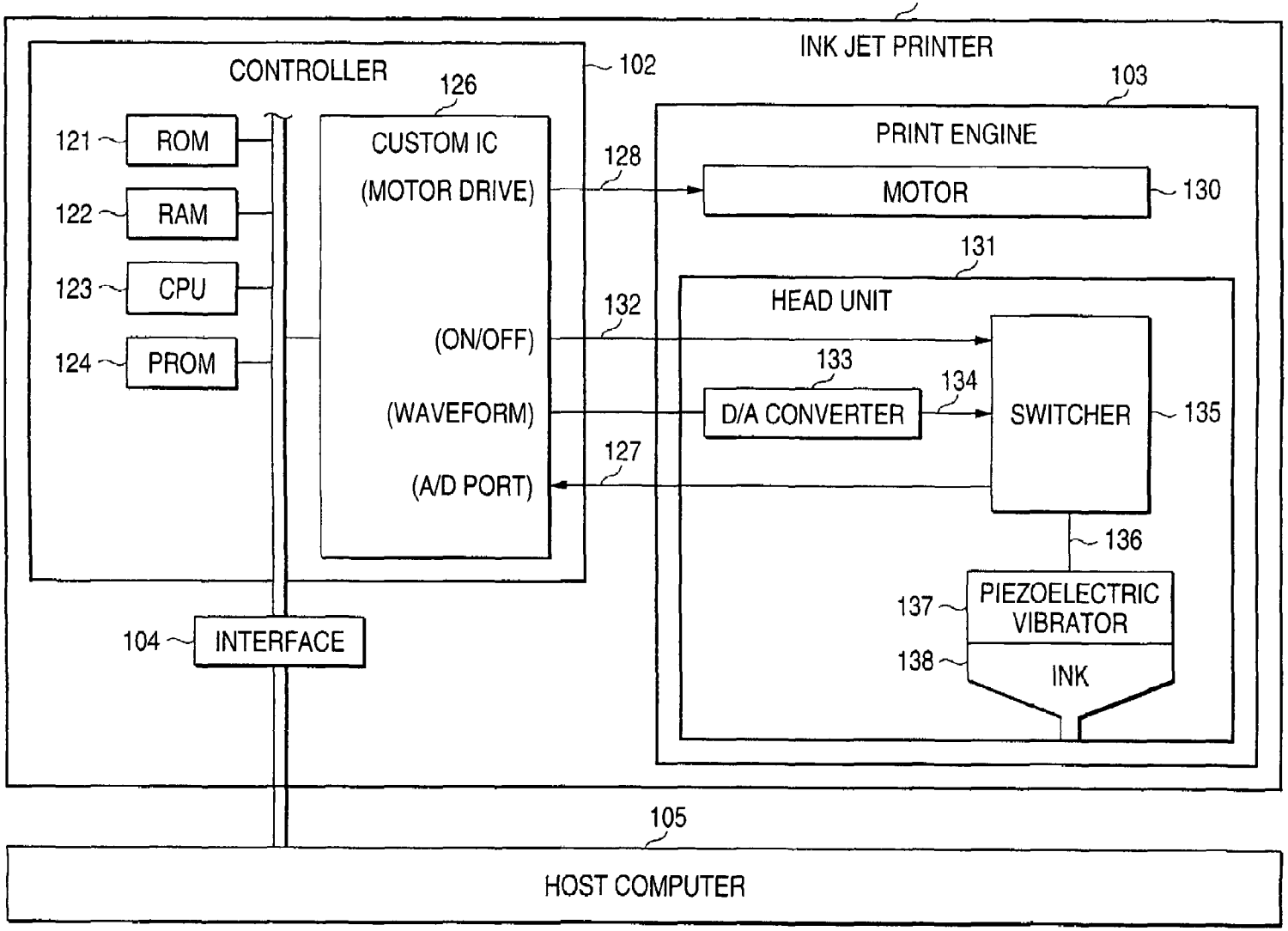
FIG. 1 is a block diagram showing a hardware configuration of a printer.

The head driver IC temperature detector 30 of such a configuration operates in the same manner as does the head drier IC temperature detector 10 shown in FIG. 1. The cables extending from the head driver ICs 11*a* through 11*d* are provided for the respective head driver ICs 11*a* through 11*d*. When a problem, such as a rupture, has arisen in any one of the cables 12*a*, 12*b*, 12*c*, and 12*d*, the temperature of only the head driver IC using the cable in which the problem has arisen fails to be detected. However, temperatures of the head driver ICs using the remaining cables can be detected.

Figure 13:
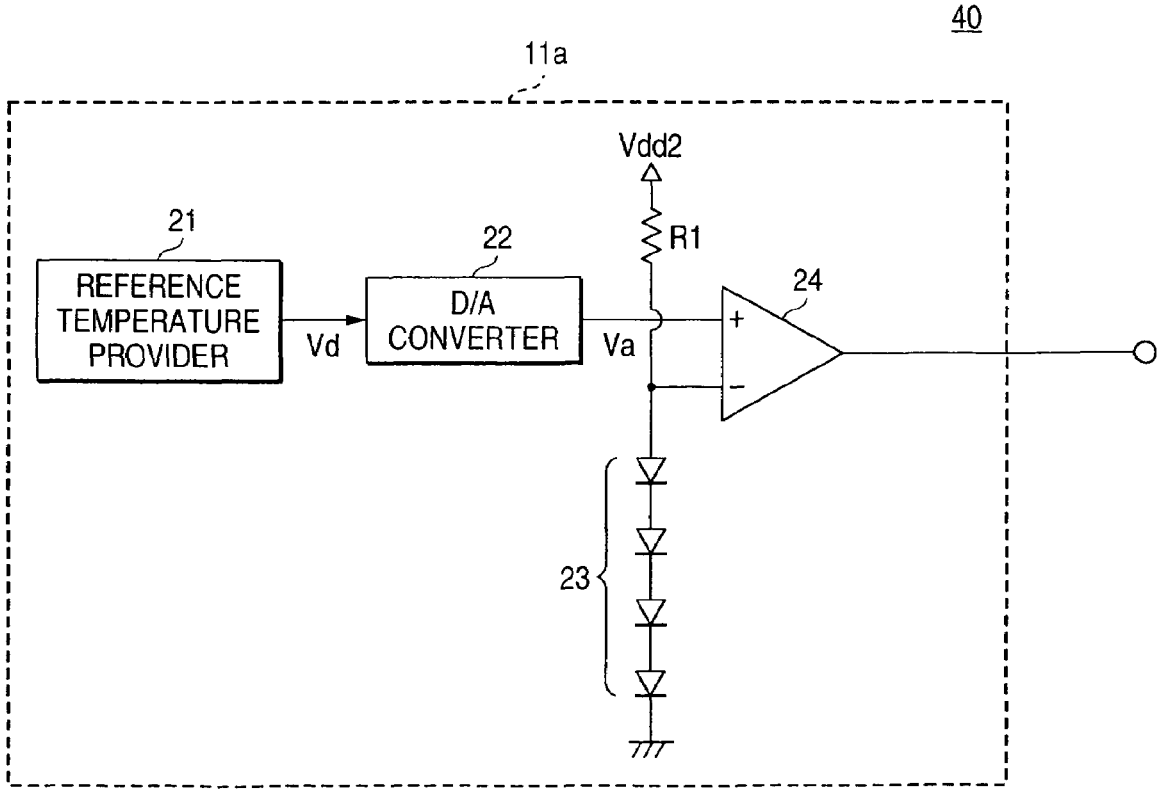
FIG. 13 is a block diagram showing the principal section of each of head drier ICs in a head driver IC temperature detector according to a third embodiment of the invention.

FIG. 13 shows a third embodiment of a head driver IC temperature detector of the invention. As shown in FIG. 13, a head driver IC temperature detector 40 is identical in configuration with the head driver IC temperature detector 10 shown in FIG. 12. They differ from each other only in the following points.

In the head driver IC temperature detector 40, outputs from the comparators 24 of the respective head driver ICs 11*a* through 11*d* are input directly to the controller 14 of the printer main unit 13, without involvement of the FET 25, by way of the mutually-independent cables 12*a*, 12*b*, 12*c*, and 12*d*.

The head driver IC temperature detector 40 of such a configuration operates in the same manner as does the head driver IC temperature detector 30 shown in FIG. 12. As a result of omission of the FET 25, a smaller number of components are required, and costs can be curtailed.

In the embodiments, each of the head driver IC temperature detectors 10, 30 is equipped with the four or eight head driver ICs. However, the number of head driver ICs is not limited to these examples; as is evident, the invention can be applied to, e.g., an ink jet printer of seven colors having seven head driver ICs, or to a monochrome ink jet printer having only one head driver IC.

In the embodiment, consideration is given to variations in the characteristics of the diodes 23 at the time of setting of the analog reference value Va. However, consideration is not limited to variations in the characteristics of diodes. Consideration may be given to individual requirements, such as heating conditions and heat radiation conditions, in connection with the layout of the respective head driver ICs 11*a* through 11*d*.

When a plurality of head driver ICs are arranged side by side, the outermost head driver ICs are subjected to relatively better heat radiation conditions, but the head driver ICs disposed inside are subjected to relatively worse heat radiation conditions. In such a case, the only requirement is that the analog reference value Va for the head driver ICs disposed inside be set to a lower level.

In this way, the analog reference value Va of each of the head driver ICs is to be set such that each of the head driver ICs does not exceed the upper limit temperature T2 during the course of a printing operation until the next temperature detecting operation.

A head driver IC temperature detector according to a fifth embodiment is characterized in determining the head driver IC whose temperature has increased in excess of a reference temperature, by sequentially changing the digital reference value Vd of the head driver ICs 11*a* through 11*h* during the temperature detection operation shown in FIG. 7, for example.

In the embodiment, when the temperature detecting signal XHOT has assumed a low level, the head driver IC that has reached a high temperature is retrieved by changing digital reference values Vd of the head driver ICs 11*a* through 11*h* one at a time. For example, the digital reference value Vd of the head driver IC 11*a* from among eight head driver ICs; that is, the head driver ICs 11*a* through 11*h*, is set to 0; the digital reference value Vd of the head driver IC 11*b* is set to 0; and, subsequently, the digital reference values Vd of the eight head driver ICs; that is, the head driver ICs 11*a* through 11*h*, are sequentially changed to 0. A head driver IC whose temperature detecting signal XHOT has been switched to a high level is specified as a head driver IC that has reached a high temperature.

By reference to FIG. 14, the temperature detecting operation of the head driver IC temperature detector of the embodiment will be described in detail.

In the head driver IC temperature detector of the embodiment, a high-level or low-level digital signal for temperature detecting purpose is input from the head driver IC to the controller 14 at all times by way of the signal line 12 provided in the FFC 16. Accordingly, the controller 14 may be able to monitor temperatures at all times, as will be described later.

Figure 14:
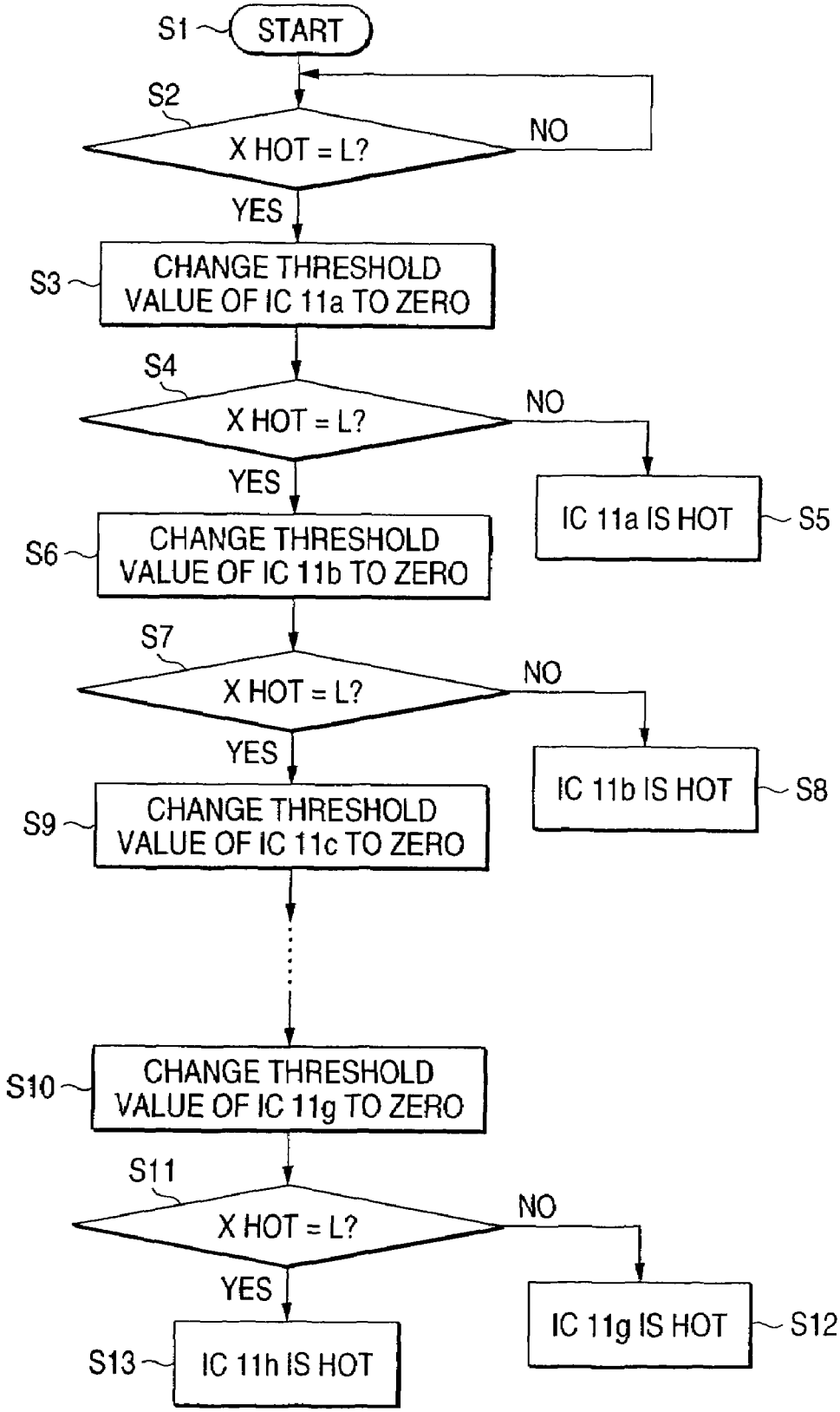
FIG. 14 is a flowchart showing an example control of temperature detecting operation of the head driver IC temperature detector according to a fifth embodiment of the invention.

In a flowchart shown in FIG. 14, in step SI the controller 14 starts detecting temperatures, and the controller 14 monitors the digital signals XHOT which are input from the respective head driver ICs 11*a* through 11*h* by way of the signal line 12 provided in the FFC 16 for detecting temperatures. Monitoring of the temperature detecting signal XHOT is performed every time printing of a single line (a single path) has been completed. In step S2, the controller 14 determines whether or not the temperature detecting signal XHOT has assumed a low level. When the signal XHOT is a high level (when NO is selected in step S2), processing returns to step S1 after printing operation for one line (signal path) has been performed, because all of the head driver ICs 11*a* through 11*h* assume the upper limit temperature T2 or less.

In step S2, when the digital signal XHOT is at a low level (when YES is selected in step S2), the controller 14 sets the eight-bit digital reference value (threshold value) [D0 to D7] (shown in FIG. 9) of the head driver IC 11*a* to zero (i.e., a setting is changed to [B00000000]) (step S3). A determination is made as to whether or not the signal XHOT has assumed a high level as a result of the setting having been changed (step S4). When the signal XHOT has assumed a high level (when NO is selected in step S4), the head driver IC 11*a* is determined to have reached a high temperature. In other words, the head drive IC 11*a* is specified as the head driver IC that has become hot (step S5). If in step S4 the signal XHOT remains at a low level (when YES is selected in step S4), a 8-bit digital reference value (threshold value) [D0 to D7] (see FIG. 9) of the head driver IC 11*b* is set to zero (step S6). By changing the setting, a determination is made as to whether or not the signal XHOT has become high (step S7). When the signal XHOT has become high (when NO is selected in step S7), the head driver IC 11*b* is determined to have become hot (step S8). If the signal XHOT remains a low level in step S7 (when YES is selected in step S7), the 8-bit digital reference value (threshold value) [D0 to D7] (see FIG. 9) of the head driver IC 11*c* is set to zero (step S9).

Subsequently, similar operations are repeated until the head driver IC that has become hot is specified. In other words, if a head driver IC which has become hot is not determined through repetition of similar operations until the head driver IC 11*f*, the 8-bit digital reference value (threshold value) [D0 to D7] (see FIG. 9) is further set to zero (step S10). A determination is made as to whether or not the signal XHOT has assumed a high level by changing the setting (step S11). When the signal XHOT has assumed a high level (when NO is selected in step S11), the head driver IC 11*g* is determined to have become hot (step S12). In contrast, if the signal XHOT remains at a low level in step S11 (when YES is selected in step S11), the finally-remaining head driver IC 11*h* is determined to have become hot (step S13).

When a head driver IC which has become hot is specified through the foregoing processing steps, the controller 14 may continue printing operation while the load imposed on the rows of nozzles (of the color) pertaining to the thus-specified head driver IC is reduced. More specifically, provided that each row of nozzles of a head has 180 nozzles, the load (i.e., availability factor) imposed on only the row of nozzles assigned to the head driver IC that has become hot can be reduced by causing only half the row of nozzles; that is, 90 nozzles, to eject ink every other operation (i.e., the switching circuit provided in that head driver IC is activated/deactivated every other operation by only an analog switch assigned to 90 nozzles). As a result, printing operation can be continued without involvement of suspension of the entire printing operation.

If a corresponding head driver IC has become hot as a result of idle ejection due to depletion of ink of a row of nozzles of interest, ink may be determined to be empty, thereby prompting replacement of an ink cartridge. Hence, the remaining quantity of ink of a row of nozzles of interest may also be determined by a software counter.

Another conceivable measure is to inform a user of a row of nozzles which are considered to have become hot and to have caused an anomaly, by an indication on a display panel of the printer main unit 13 or blinking of an LED.

As a matter of course, the entire printing operation (i.e., of all rows of nozzles) may be suspended for a predetermined time period.

The controller 14 has been described as detecting (monitoring) temperatures every time printing of a single line (i.e., a single path) has been completed. More specifically, the controller 14 preferably detects temperatures every time printing of a single line (a single path) has been completed, when the head is situated at the end (i.e., the termination) of the single path in a main scanning direction, or when the head is situated at the end (i.e., the start) of the next single path in the main scanning direction performed every time printing of a single line (a single path) has been completed.

Figure 15:
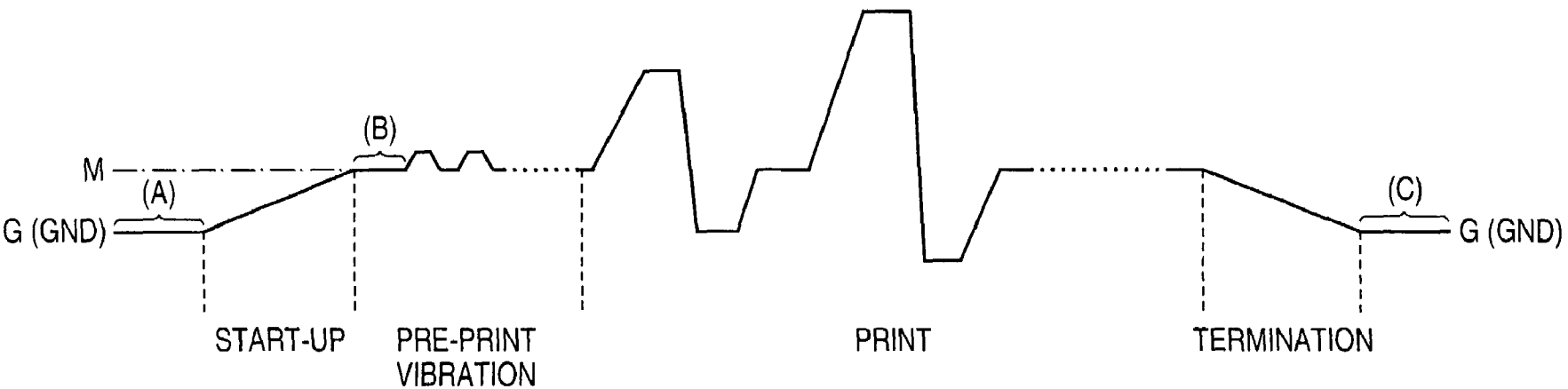
FIG. 15 is a view showing variations in the waveform of a drive waveform for a single path of a print head.

FIG. 15 is a chart showing changes in the waveform of a drive waveform (COM) of a single line (a single path). When the head is situated at the initial end of a single path in the main scanning direction, the drive waveform (COM) assumes a ground potential (G). The potential rises up to an intermediate potential (M) as a result of a start-up operation which is performed until the head moves to a location from which printing on recording paper is started. Subsequently, a waveform is applied to the head to finely vibrate a meniscus of ink in the nozzle such an extent that ink is not ejected therefrom as a pre-print vibrating operation, thereby rendering ink available. By printing operation, various types of waveforms to be used for causing nozzles to eject ink of particle sizes corresponding to print data are applied to the head until the head reaches a location at which printing on the recording paper is finished. Subsequently, the potential of the drive waveform (COM) is reduced to a ground potential (G) by a terminating operation from the time the head leaves the location where printing operation is to be terminated until the time the head reaches the end (termination) of the single path in the main scanning direction.

In FIG. 15, temperature detecting operation is to be performed in a flat portion where the drive waveform (COM) has no ascent or descent; for example, A) when the head is situated at the initial end of the single path in the main scanning direction and when the drive waveform assumes the ground potential G; B) at a time after the waveform has risen up to an intermediate potential M and immediately before the pre-print vibrating operation; or C) when the head is situated at the termination end of the single path after the potential of the drive waveform (COM) drops to the ground potential G by the terminating operation. The reason for this is that, during the course of ascending or descending operation of the drive waveform (COM), a relatively-large current for charging or discharging a piezoelectric element passes through a signal line for a drive waveform provided in the FFC 16, and hence the drive waveform is to be protected from the influence of the current.

Figure 16:
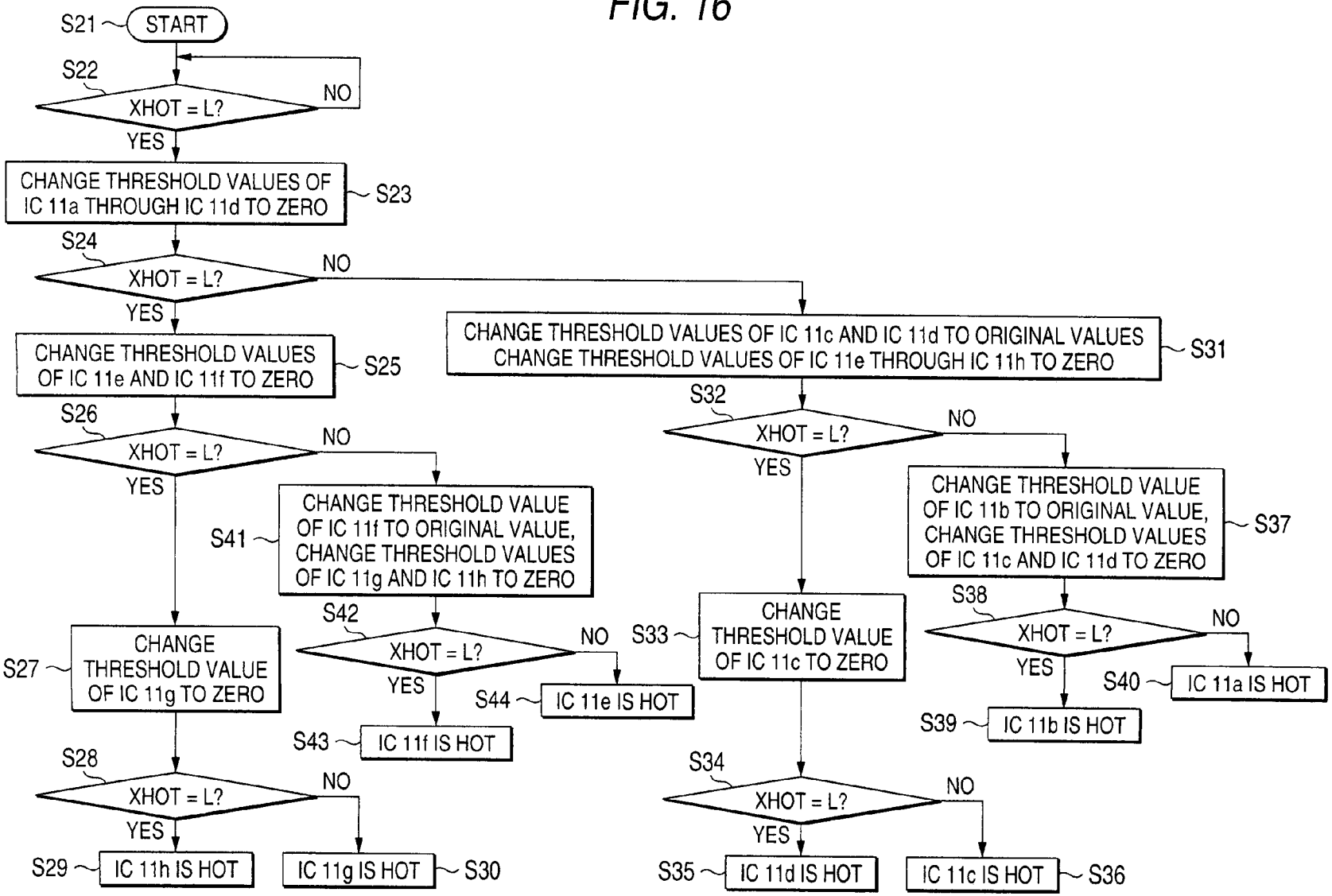
FIG. 16 is a flowchart showing an example control of temperature detecting operation of a head driver IC temperature detector according to a sixth embodiment of the invention.

FIG. 16 shows a sixth embodiment of the head driver IC temperature detector of the invention, which is identical in configuration with the head driver IC temperature detector 10 shown in FIGS. 7 through 9, and they differ from each other in only a detecting operation to be described later.

The fifth embodiment requires that a digital reference value (threshold value) (i.e., changing of a setting to [0000000]) be switched as many as seven times until the finally-remaining head driver IC 11*h*. In contrast, in the sixth embodiment, in order to avoid complication, digital reference values (threshold values) of four head driver ICs are simultaneously switched to 0. Next, digital reference values (threshold values) of two head driver ICs are simultaneously switched to 0. Further, a digital reference value (threshold value) of one head driver IC is switched to 0. Thus, the head driver IC that has become hot can be specified by only three switching operations.

According to the flowchart shown in FIG. 16, when in step S21 the controller 14 commences a temperature detecting operation, the controller 14 monitors digital signals XHOT which are input from the head driver ICs 11*a* through 11*h* by way of the signal line 12 of the FFC 16 for detecting temperatures. The temperature detecting signals XHOT are monitored every time printing of a single line (a single path) has been completed. In step S22, the controller 14 determines whether or not the temperature detecting signal XHOT has assumed a low level. When the signal XHOT is at a high level (when NO is selected in step S22), the temperatures of all the head driver ICs 11*a* through 11*h* are below the upper limit temperature T2. Hence, after printing operation of the line (single path) has been performed, processing returns to step S21.

When in step S22 the digital signal XHOT is a low level (when YES is selected in step S22), the controller 14 sets to zero eight-bit digital reference values (threshold value) [D0 to D7] (see FIG. 9) of four head driver ICs 11*a*, 11*b*, 11*c*, and 11*d* (the setting is changed to [00000000]) (step S23). A determination is made as to whether or not the signal XHOT has assumed a high level as a result of changing of the setting (step S24). If the signal XHOT remains at a low level (when YES is selected in step S24), the 8-bit digital reference values (threshold values) [D0 to D7] (see FIG. 9) of the head driver ICs 11*e*, 11*f* are set to zero (step S25). A determination is made as to whether or not the signal XHOT has assumed a high level as a result of changing of the setting (step S26). If the signal XHOT remains at a low level (when YES is selected in step S26), the 8-bit digital reference value (threshold value) [D0 to D7] (see FIG. 9) of the head driver IC 11*g* is set to zero (step S27). A determination is made as to whether or not the signal XHOT has assumed a high level as a result of changing of the setting (step S28). If the signal XHOT remains at a low level (when YES is selected in step S28), a determination is made as to whether or not the finally-remaining head driver IC 11*h* has become hot (step S29). In contrast, when the XHOT has assumed a high level (when NO is selected in step S28), the head driver IC 11*g* is determined to have become hot (step S30).

In step S24, when the signal XHOT has assumed a high level (when NO is selected in step S24), the IC that has become hot is assumed to be any one of the four head drier ICs 11*a*, 11*b*, 11*c*, and 11*d*. Next, the digital reference values (threshold values) of the two head driver ICs 11*c*, 11*d* among the four head driver ICs 11*a* through 11*d* are reset to their original values from zero. Moreover, the digital reference values (threshold values) of the four head driver ICs 11*e*, 11*f*, 11*g*, and 11*h* are set to zero (step S31). A determination is made as to whether or not the signal XHOT has assumed a high level as a result of changing of the setting (step S32). If the signal XHOT remains at a low level (when YES is selected in step S32), the digital reference value (threshold value) of the head driver IC 11*c* is set to zero (step S33). A determination is made as to whether or not the signal XHOT has assumed a high level as a result of changing of the setting (step S34). If the signal XHOT remains at a low level (when YES is selected in step S34), the head driver IC 11*d* is determined to have become hot (step S35). In contrast, when the signal XHOT has assumed a high level (when NO is selected in step S34), the head driver IC 11*c* is determined to have become hot (step S36).

When in step S32 the signal XHOT has assumed a high level (when NO is selected in step S32), either of the two head driver ICs 11*a*, 11*b* is presumed to have become hot, in view that the signal XHOT has assumed a high level as a result of the digital reference values (threshold values) of the two head driver ICs 11*c*, 11*d* being reset to their original values from zero. Next, the digital reference value (threshold value) of the head driver IC 11*b* is reset to its original value from zero and digital reference values (threshold values) of the two head driver ICs 11*c*, 11*d* are set to zero (step S37). A determination is made as to whether or not the signal XHOT has assumed a high level as a result of changing of the setting (step S38). If the signal XHOT remains at a low level (when YES is selected in step S38), the head driver IC 11*b* is determined to have become hot (step S39). In contrast, when the signal XHOT has assumed a high level (when NO is selected in step S38), the head driver IC 11*a* is determined to have become hot (step S40).

When in step S26 the signal XHOT has assumed a high level (when NO is selected in step S26), either of the two head driver ICs 11*e*, 11*f* is presumed to have become hot, in view that the signal XHOT has assumed a high level as a result of the digital reference values (threshold values) of the two head driver ICs 11*e*, 11*f* being reset to their original values from zero. Next, the digital reference value (threshold value) of the head driver IC 11*b* is reset to its original value from zero and digital reference values (threshold values) of the two head driver ICs 11*g*, 11*h* are set to zero (step S41). A determination is made as to whether or not the signal XHOT has assumed a high level as a result of changing of the setting (step S42). If the signal XHOT remains at a low level (when YES is selected in step S42), the head driver IC 11*f* is determined to have become hot (step S43). In contrast, when the signal XHOT has assumed a high level (when NO is selected in step S42), the head driver IC 11*e* is determined to have become hot (step S44).

The fifth embodiment requires that the digital reference value (threshold value) be switched as many as seven times. In the sixth embodiment, the head driver IC that has become hot can be specified by only three switching operations. Even in the embodiment, printing operation can be continued without involvement of suspension of the entire printing operation, by reducing the load (availability factor) imposed on the row of nozzles that have become hot. Further, a further increase in the temperature of the head driver IC can be prevented. Moreover, if a corresponding head driver IC has become hot as a result of idle ejection due to depletion of ink of a row of nozzles of interest, ink may be determined to be empty, thereby prompting replacement of an ink cartridge. Another conceivable measure is to inform a user of a row of nozzles which are considered to have become hot and to have caused an anomaly, by an indication on a display panel of the printer main unit 13 or blinking of an LED.

As in the fifth embodiment, an essential consideration in the sixth embodiment is the timing at which the controller 14 is to detect temperatures.

In the fifth and sixth embodiments, the head driver IC temperature detector has eight head driver ICs 11*a* through 11*h*. However, as is evident, the invention can be applied to another ink jet printer having a plurality of head driver ICs. Briefly speaking, the invention can be applied to any ink jet printer, so long as the printer has at least two head driver ICs.

In the embodiments, consideration is given to variations in the characteristic of the diode 23 at the time of setting of the analog reference value Va. However, the invention is not limited to this embodiment; consideration may also be given to individual conditions, such as heating conditions or heat radiation conditions, resulting from the layout of the individual head driver ICs 11*a* through 11*h*.

For instance, when a plurality of head driver ICs are arranged side by side, outermost head driver ICs are subjected to relatively better heat dissipation conditions, whereas head driver ICs provided at inner positions are subjected to relatively worse heat dissipation conditions. In such a case, the analog reference value Va pertaining to the inner head driver ICs may be set to a lower level.

In this way, the only requirement is to set the analog reference value Va of each of the head driver ICs such that the temperature of each of the head driver ICs does not exceed the upper limit temperature T2.

In the fifth embodiment, the digital reference value (threshold value) is switched as many as seven times until the final head driver IC. In the sixth embodiment, the digital reference value (threshold value) is switched three times. However, as a matter of course, procedures for switching the digital reference value (threshold value) are not limited to the methods plotted in the form of the flowcharts shown in FIGS. 11 and 13.

The invention is not limited to the head driver IC temperature detection processing shown in FIGS. 11 and 13. As a matter of course, the invention can be applied to a computer-readable recording medium having the processing recorded thereon or a computer program for executing the processing.

In the fifth and sixth embodiments, an increase in the temperatures of the head driver ICs above a predetermined temperature has been detected. However, as is also evident, a decrease in the temperatures of the head driver ICs below a predetermined temperature can be detected on the same principle and a head driver IC whose temperature has dropped can be specified.

An operation of a head driver IC temperature detector according to a seventh embodiment will now be described. This operation can be executed in the configuration shown in FIGS. 7 to 9. In this embodiment, during the course of a failure detecting operation of the temperature detecting circuit, the setting of a digital-to-analog converter is first periodically maximized, and switching of a temperature detecting signal from a "low temperature" to a "high temperature" is ascertained.

The digital reference values Vd (i.e., the threshold values of the digital-to-analog converters) of the respective driver ICs 11*a* through 11*h* are periodically, sequentially changed to a maximum number of 255 [11111111]; specifically, when power is activated, when printing operation is awaited, or when page break is performed during the course of printing operation, thereby detecting occurrence of a failure in each of the head driver ICs. If not all signals for the head driver ICs 11*a* through 11*h* are switched, occurrence of a rupture in an FFC is suspected.

In this way, a check can be made as to whether or not the temperature detecting circuits operate properly, by periodically maximizing the settings of the digital-to-analog converters.

Second, when the temperature detecting circuit has detected a temperature hike, the settings of all the digital-to-analog converters are temporarily set to a minimum value of zero [00000000], thereby ascertaining whether or not temperature detecting signals are reset to their original states. If the temperature detecting signals fail to be reset to their original states, occurrence of a serious failure, such as a short circuit, on a head board, is suspected. For this reason, operation of the printer is suspended immediately.

When the temperature detecting circuit has detected a temperature hike, the settings of all the digital-to-analog converters are minimized, thereby enabling a check as to whether or not a temperature hike has actually arisen or the temperature hike is attributable to a mechanical failure.

By reference to FIG. 17, a failure detection operation of this embodiment will be described in detail.

In the embodiment, a high-level or low-level digital signal for detecting a temperature is input from the head driver IC to the controller 14 at all times by way of the signal line 12 provided in the FFC 16. Accordingly, the controller 14 can monitor detection of a temperature at all times. Alternatively, the controller may detect a temperature after printing operation for one line (signal path) has been performed.

Figure 17:
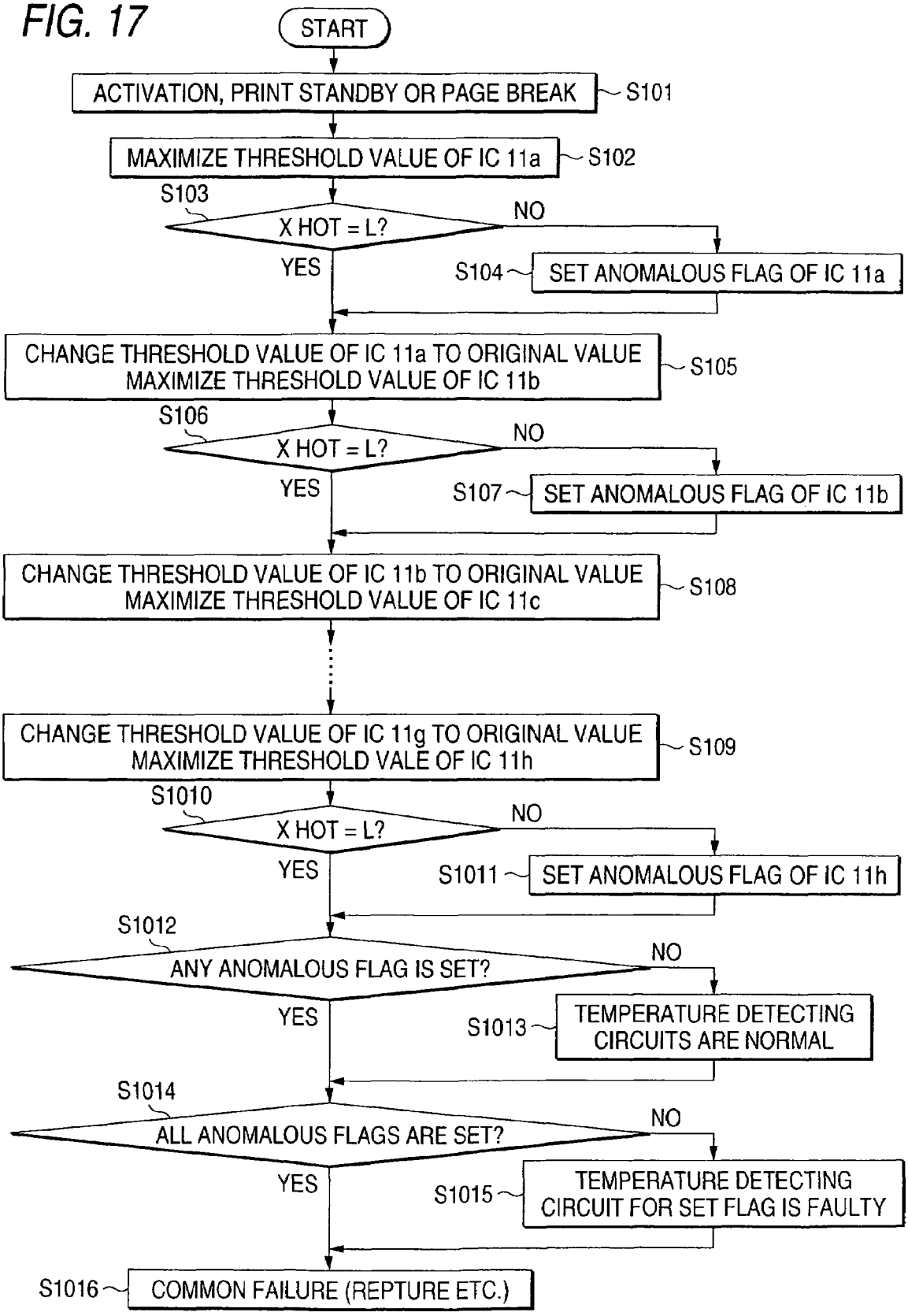
FIG. 17 is a flowchart showing a failure detecting operation performed in a head driver IC temperature detector according to a seventh embodiment.

According to the flowchart shown in FIG. 17, a failure detection operation of the embodiment is performed periodically; specifically, when power is activated, when printing operation is awaited, and when a page break is implemented during the course of printing operation. More specifically, the following failure detecting operation is executed when power is activated, when printing operation is awaited, and when a page break is implemented during the course of printing operation (step S101). In step S102, the controller 14 sets an 8-bit [D0 to D7] digital reference value (threshold value) (see FIG. 9) of the head driver IC 11*a* to a maximum value of 255 (i.e., a setting is switched to [11111111]). A determination is made as to whether or not the signal XHOT has been switched to a low level as a result of changing of the setting (step S103). When the signal XHOT has not been switched to a low level (when NO is selected in step S103), an anomalous flag is set for the head driver IC 11*a* (step S104). Next, the 8-bit [D0 to D7] digital reference value (threshold value) of the head driver IC 11*a* is reset to its original value, and the 8-bit [D1 to D7] digital reference value (threshold value) of the head driver IC 11*b* is set to a maximum value of 255 (i.e., the setting is changed to [11111111]) (step S105). By changing the setting, a determination is made as to whether or not the signal XHOT has been switched to a low level (step S106). If the signal XHOT has not been switched to a low level (when NO is selected in step S106), an anomalous flag is set for the head driver IC 11*b* (step S107). Moreover, the 8-bit [D0 to D7] digital reference value (threshold value) of the head driver IC 11*b* is reset to its original value, and the 8-bit [D1 to D7] digital reference value (threshold value) of the head driver IC 11*c* is set to a maximum value of 255 (i.e., the setting is changed to [11111111]) (step S108).

Subsequently, a similar operation is repeated for all remaining head driver ICs until the head driver IC 11*g*. The 8-bit [D0 to D7] digital reference value (threshold value) of the head driver IC 11*g* is reset to its original value, and the 8-bit [D1 to D7] digital reference value (threshold value) of the head driver IC 11*h* is set to a maximum value of 255 (i.e., the setting is changed to [11111111]) (step S109). A determination is made as to whether or not the signal XHOT has been switched to a low level as a result of changing of the setting (step S1010). If the signal XHOT has not been switched to a low level (when NO is selected in step S1010), an anomalous flag is set for the head driver IC 11*h* (step S1011). A determination is made as to whether or not anomalous flags are set for the head driver ICs 11*a* through 11*h* (step S1012). If no anomalous flag is set for any of the head driver ICs 11*a* through 11*h* (when NO is selected in step S1012), the temperature detecting circuits determine that the head driver ICs are normal (step S1013). If an anomalous flag is determined to have been set in step S1012 (when YES is selected in step S1012), a determination is made as to whether or not anomalous flags are set for all of the head driver ICs 11*a* through 11*h* (step S1014). If anomalous flags are not set for all the head driver ICs (when NO is selected in step S1014), the head driver ICs for which the anomalous flags are set are considered to be anomalous (faulty) (step S1015).

When all the flags are set (when YES is selected in step S1014), individual head driver ICs are not considered to be anomalous (faulty) but a rupture is determined to have arisen in the signal lines 12 provided in the FFC 16; that is, a fault common to all the head driver ICs is determined to have arisen (step S1016).

In the steps S104 through S1011, at a point in time when an anomalous flag is set for the head driver IC, a corresponding temperature detecting circuit may be determined to have become anomalous (faulty).

When any one of the head driver ICs has become faulty or a common fault has arisen, the controller 14 performs a pertinent processing operation as a countermeasure against the fault. The user is informed of occurrence of a failure by, e.g., temporarily suspending the operation of the printer, displaying an indication on a display panel of the printer main body 13, or blinking an LED.

Figure 18:
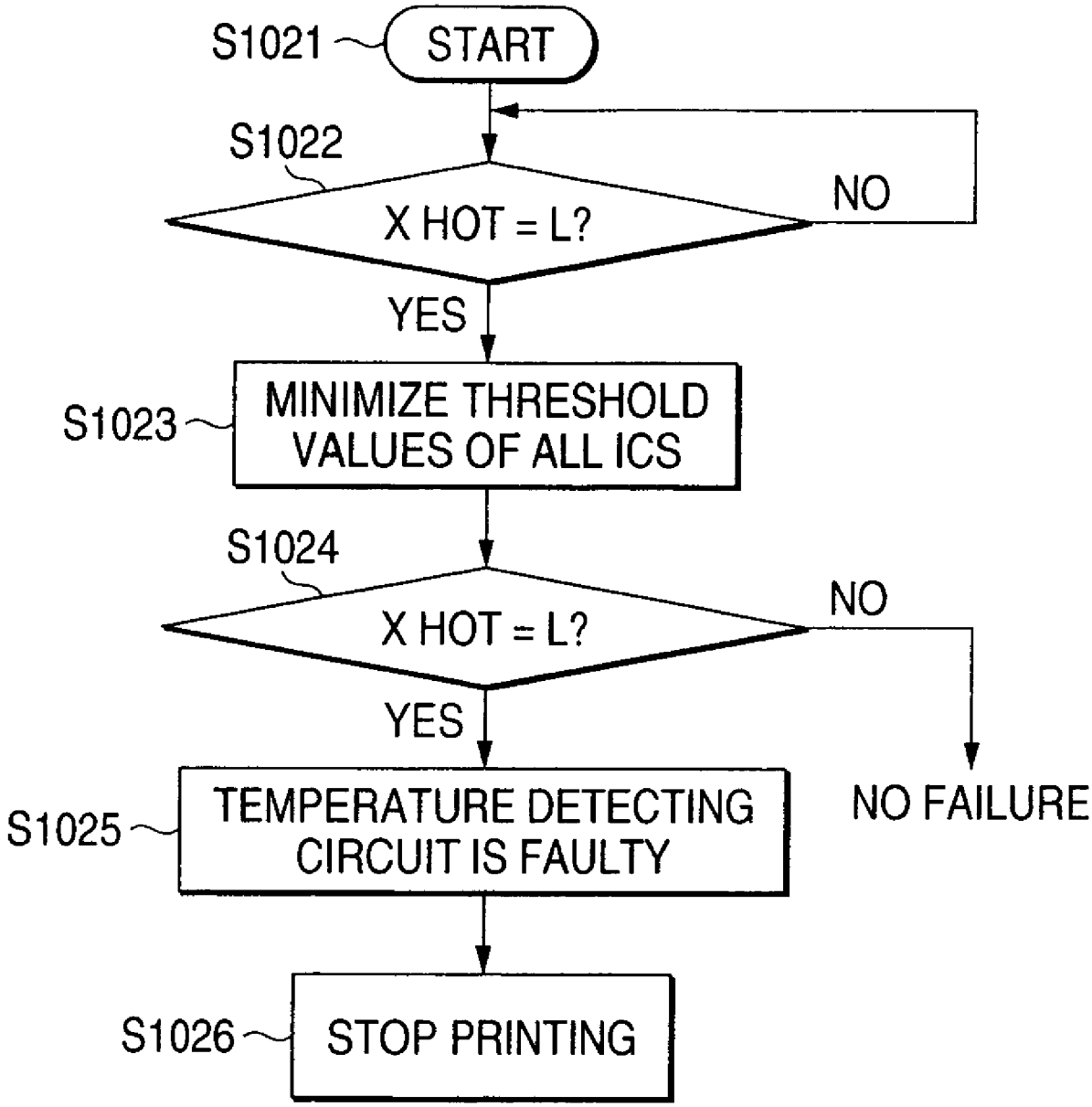
FIG. 18 is a flowchart showing a failure detecting operation performed in a head driver IC temperature detector according to an eighth embodiment.

FIG. 18 shows an operation performed in a head driver IC temperature detector according to an eighth embodiment. This operation can be executed in the configuration shown in FIGS. 7 to 9.

In the seventh embodiment, occurrence of a failure in the head driver IC temperature detecting circuits is periodically performed; specifically, when power is activated, when printing operation is awaited, or when page break is performed during the course of printing operation, regardless of an operation for detecting temperatures of head driver ICs. In the eighth embodiment, when an increase in the temperatures of the head driver ICs are detected by temperature detecting operations of the head driver ICs, occurrence of a failure is checked, for confirmation.

In the embodiment, in connection with the flowchart shown in FIG. 18, the controller 14 starts a temperature detecting operation in step S1021. Then, the controller 14 monitors digital signals XHOT which are input from the respective head driver ICs 11*a* through 11H by way of the signal line 12 provided in the FFC 16 for detecting temperatures. Monitoring of the temperature detecting signal XHOT is performed at, e.g., a point in time when printing of a single line (i.e., a single path) has been completed. In step S1022, the controller 14 determines whether or not the temperature detection signal XHOT has assumed a low level. When the signal XHOT assumes a high level (when NO is selected in step S1022), all the head driver ICs 11*a* through 11*h* assume values smaller than the upper limit temperature T2. Hence, after printing of a single line (i.e., a single path) has been completed, processing returns to step S1021.

Figure 3:
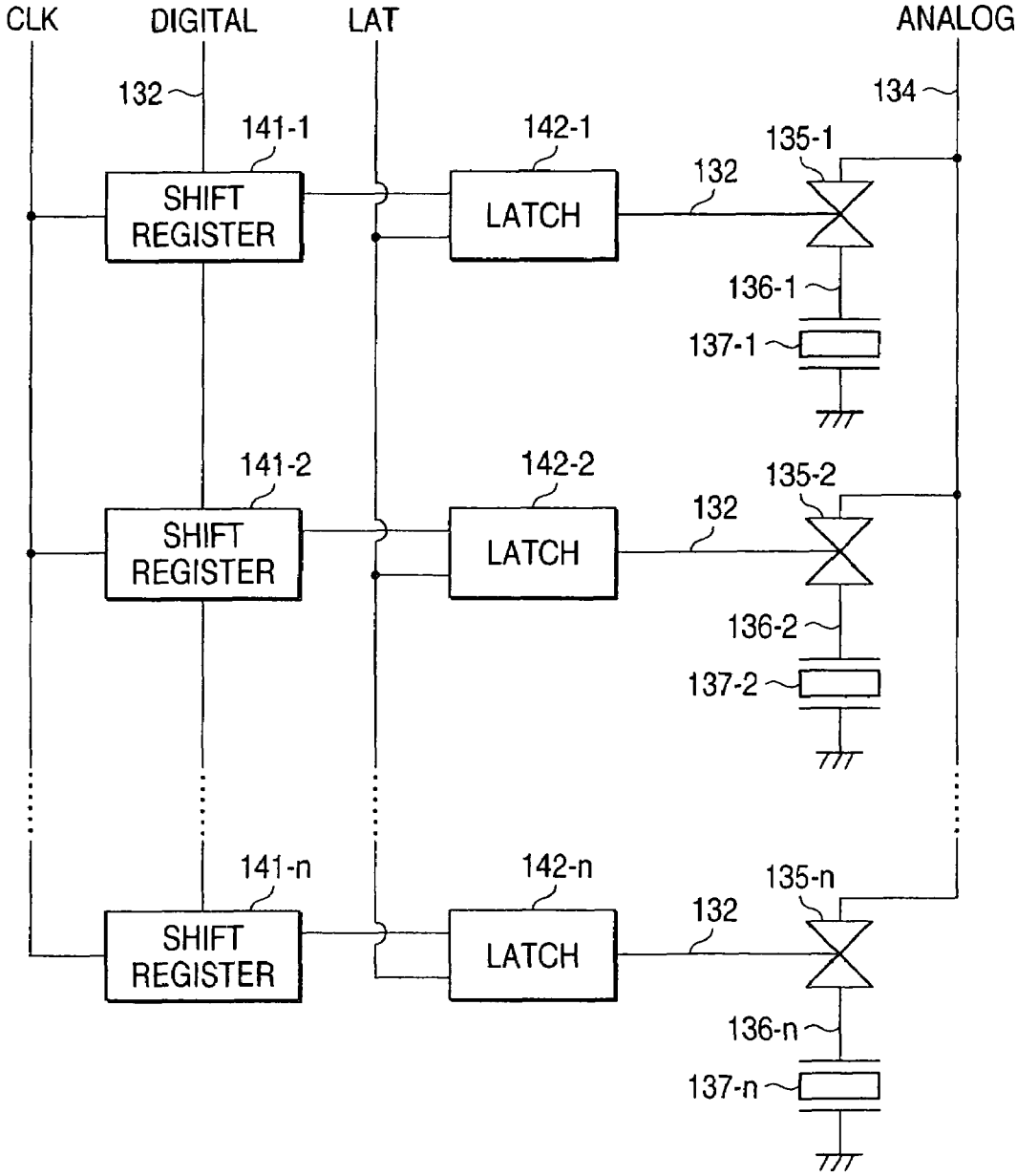
FIG. 3 is a schematic diagram showing a configuration for activating a piezoelectric vibrator using a switcher.
Figure 4:
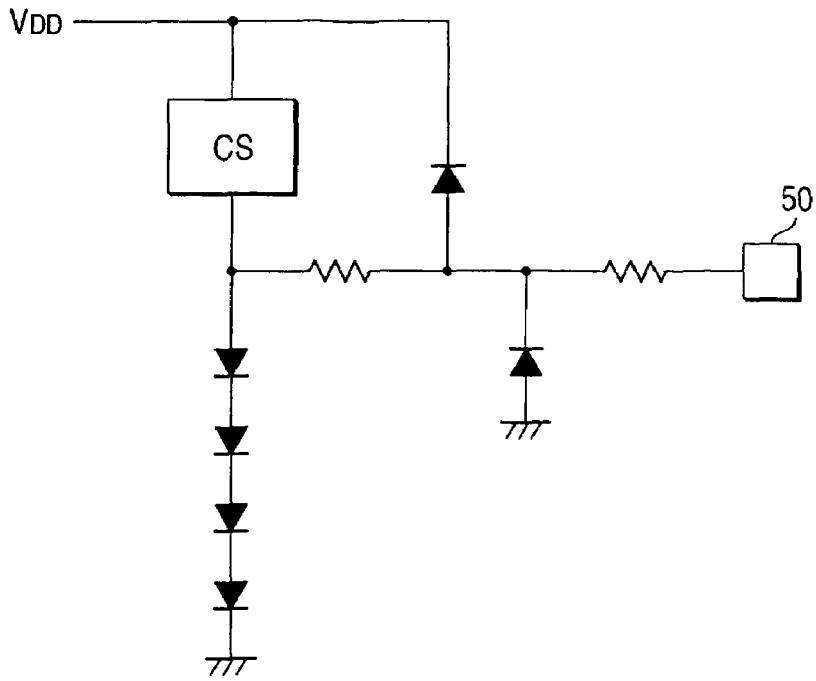
FIG. 4 is a schematic diagram showing an example configuration of a related-art temperature detecting circuit.
Figure 5:
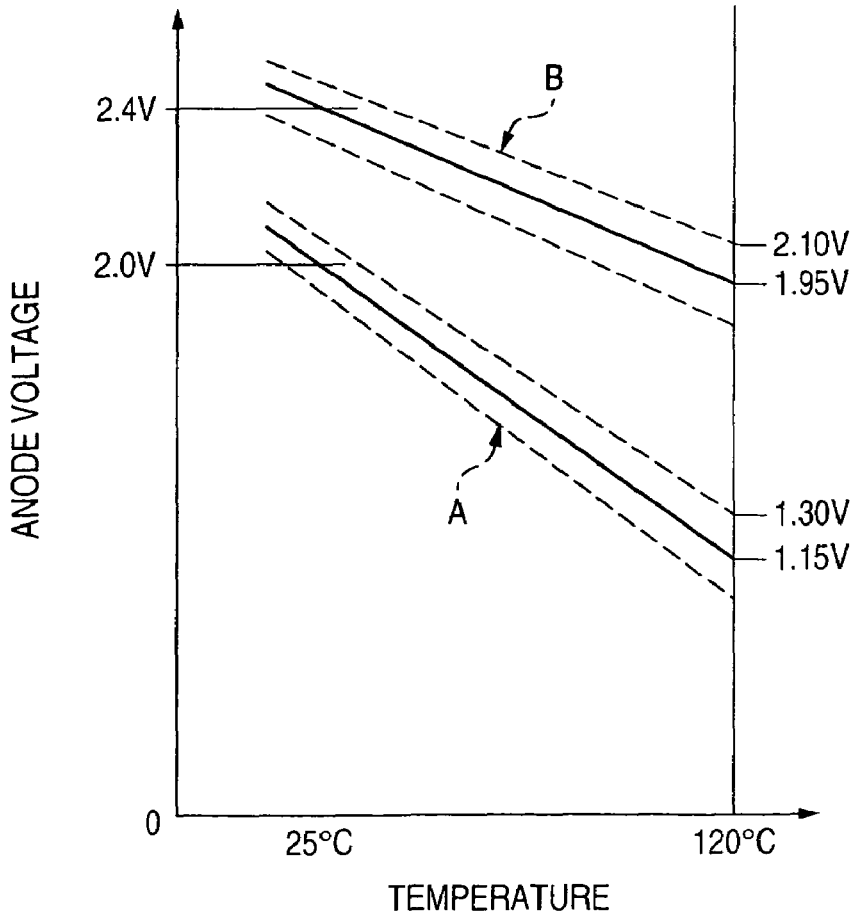
FIG. 5 is a graph representing the characteristics of the related-art temperature detecting circuit.
Figure 6:
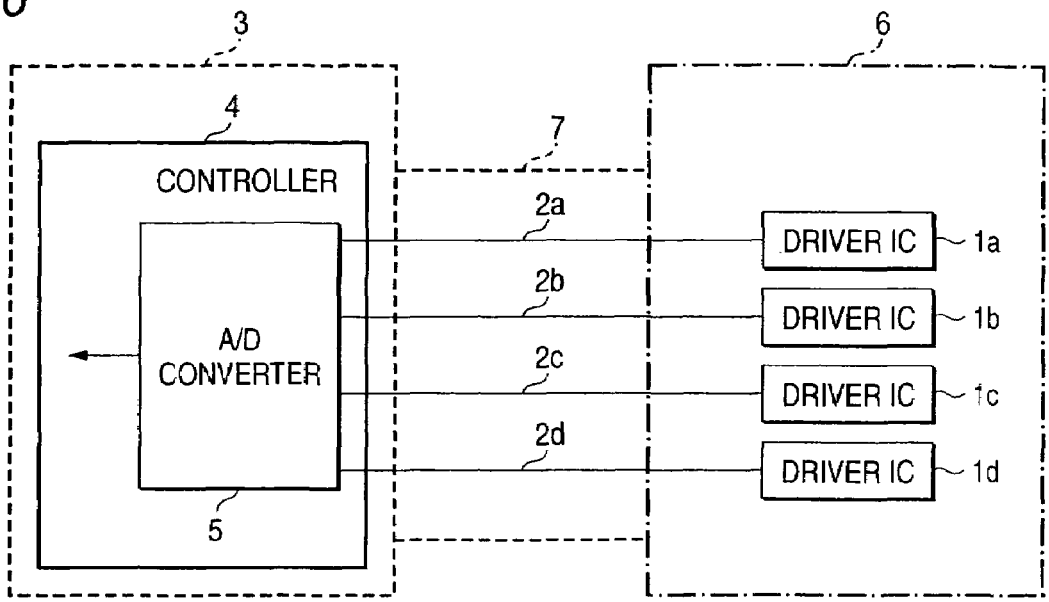
FIG. 6 is a block diagram showing a related-art temperature detector for a head driver IC.

When in step S1022 the digital signals XHOT are determined to assume a low level (when YES is selected in step S1022), the controller 14 sets 8-bit [D0 to D7] digital reference values (threshold values) (see FIG. 3) of all the head driver ICs 11*a* through 11*h* to a minimum value of zero (step S1023). A determination is then made as to whether or not the signals XHOT have been switched to a high level as a result of changing of the settings (step S1024). If the signals XHOT have been switched to a high level (when NO is selected in step S1024), no fault is determined to have arisen. Hence, processing can proceed to an operation for detecting temperatures of the respective head driver ICs 11*a* through 11*h*.

If in step S1024 the signals XHOT are determined to remain at a low level (when YES is selected in step S1024), occurrence of a serious failure, e.g., a short circuit attributable to leakage of ink into the head board, is suspected. Hence, the temperature detecting circuits are determined to be faulty (step S1025), and the operation of the printer is immediately stopped (step S1026).

In the seventh and eighth embodiments, the head driver IC temperature detector has eight head driver ICs 11*a* through 11*h*. However, the invention is not limited to such embodiments. Obviously, the invention can be applied to another ink jet printer having a plurality of head driver ICs.

In the seventh embodiment, the digital reference values (threshold values) are switched a maximum of eight times until the final head driver IC. However, as a matter of course, procedures for switching the digital reference values (threshold values) are not limited to the method denoted by the flowchart shown in FIG. 17.

In the seventh embodiment, the digital reference values (threshold values) of respective head driver ICs are switched to a maximum value of 255. However, as long as the respective head driver ICs are normal, a maximum value is not limited to 255 if the signals XHOT are switched to a low level.

In the eighth embodiment, the digital reference values (threshold values) of respective head driver ICs are switched to a minimum value of zero. However, so long as the respective head driver ICs are normal, a minimum value is not limited to zero if the signals XHOT are switched to a high level.

The invention is not limited to the processing shown in FIGS. 17 and 18. As a matter of course, the invention can also be applied to a computer-readable recording medium having the processing recorded thereon or a computer program to be used for executing the processing.

Figure 2:
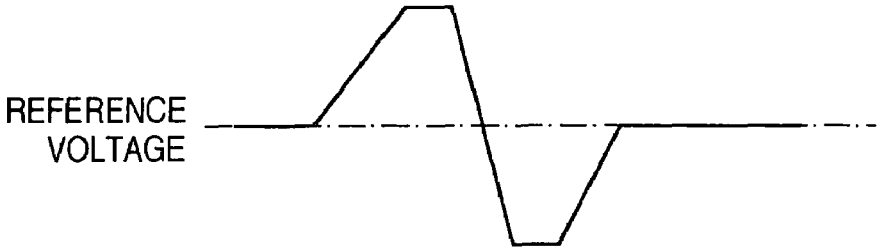
FIG. 2 is a view showing an example of analog waveform data utilized in the printer.
Figure 19:
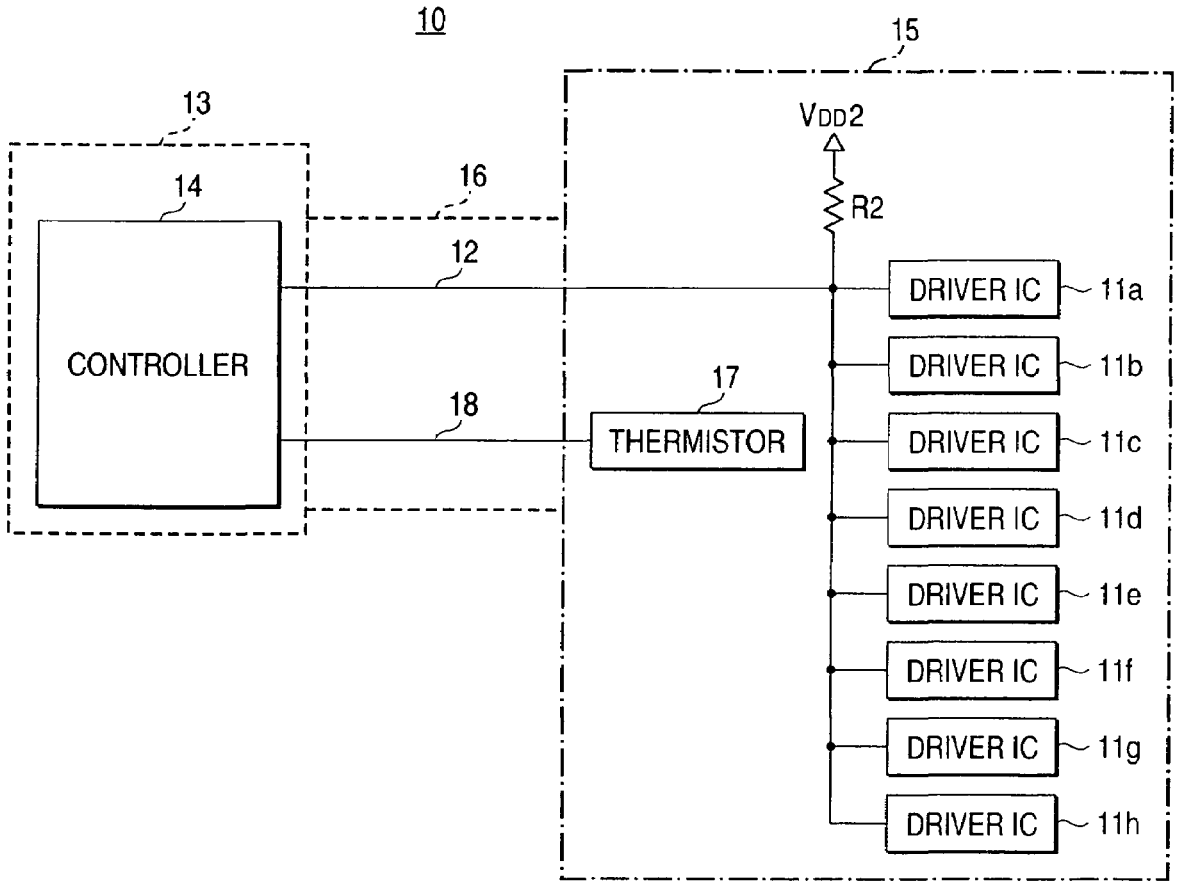
FIG. 19 is a block diagram showing the configuration of a head driver IC temperature detector according to a ninth embodiment of the invention.

FIG. 19 shows a head drive IC temperature detector according to a ninth embodiment. In this embodiment, a thermistor 17 is mounted on a head board of the print head 15. The thermistor 17 is provided for detecting a temperature of the neighborhood of the head (i.e., an ambient temperature) with a view toward effecting temperature correction operation on the basis of a drive waveform (i.e., an analog trapezoidal waveform shown in FIG. 2). Attention is paid to the ability of a thermistor to effect high-precision measurement. When the temperature of the print head has increased with reference to a room temperature (25° C.), the drive waveform (i.e., an analog trapezoidal waveform shown in FIG. 2) is applied to the print head by performing corrections, such as a reduction in the maximum voltage. In contrast, when the temperature of the print head has dropped with reference to the room temperature, the drive waveform is applied to the print head by performing corrections, such as an increase in the maximum voltage. Therefore, the ambient temperature is detected by the thermistor 17 every time printing of one page is completed. The temperature detecting signal is output to the controller 14 provided in the printer main unit 13 by way of a signal line 18 provided in the FFC 16. Upon receiving the temperature detecting signal, the controller 14 produces a drive waveform resulting from the previously-described correction of the maximum voltage, and applies the waveform to the print head.

Figure 21:
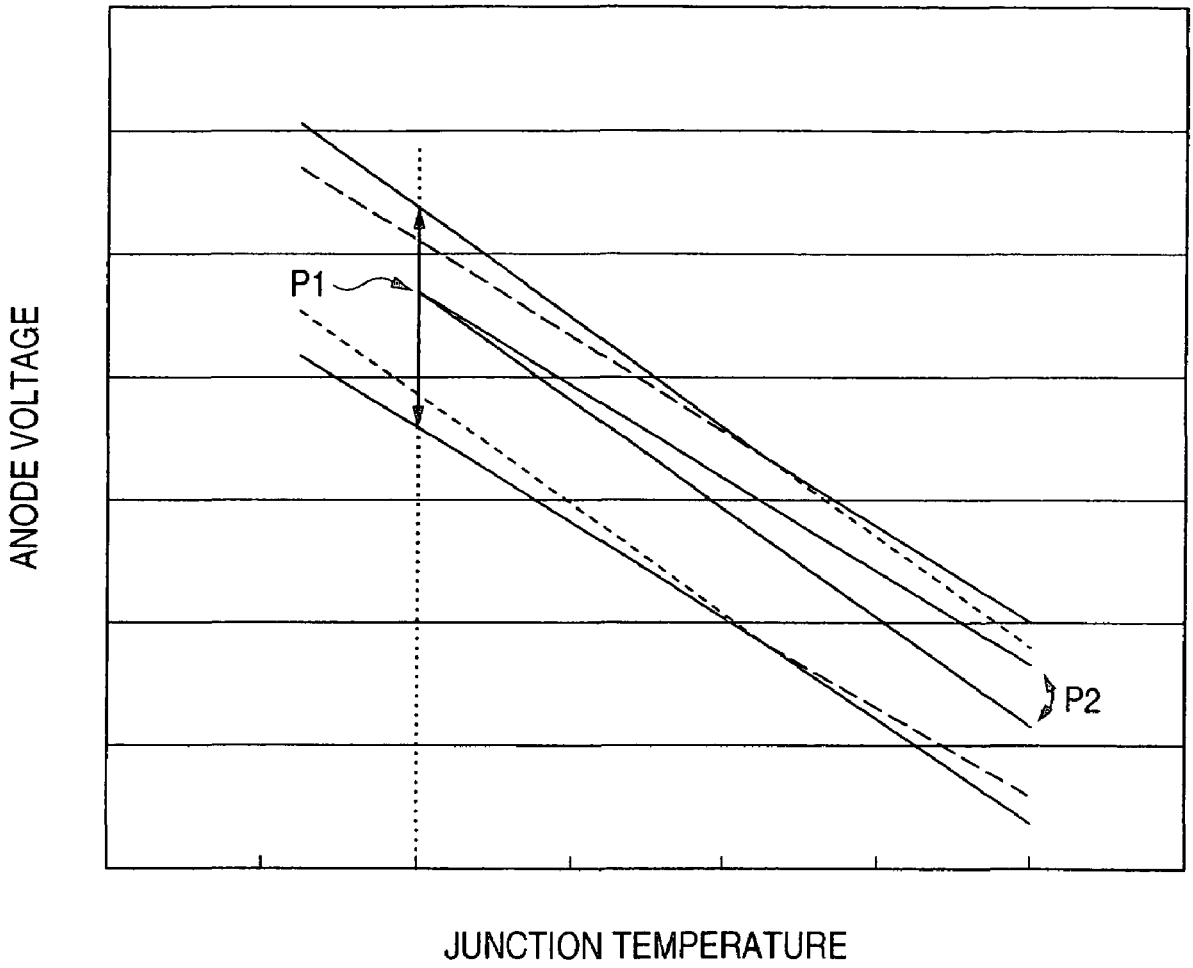
FIG. 21 is a graph showing a method of correcting individual differences in the anode voltages of diodes through use of the thermistor provided on a head board.

More specifically, during the course of printing operation, the internal temperatures of the head driver ICs differ from the temperature of the neighborhood of the head (i.e., the ambient temperature). However, immediately after the printer has been activated, the temperatures are considered to coincide with each other. Individual differences in anode voltages of the diodes are corrected through use of temperatures measured by the thermistor. The load capacity of each row of nozzles has been stored beforehand in a storage, such as a non-volatile RAM. The magnitude of change in anode voltage is measured, by applying to the print head, a specified number of times, a drive waveform pulse pertaining to a voltage at which no ink is ejected. So long as a drive waveform pulse is applied to the print head a specified number of times even at a voltage at which no ink is to be ejected, the internal temperatures of the respective head driver ICs are increased correspondingly, and hence anode voltages drop. Accordingly, temperature coefficients of anode voltages of the diodes provided in the head driver ICs are determined based on the stored load capacity of each row of nozzles and the drive waveform pulse (amplitude, voltage application time period, etc.). The determined temperature coefficients are compared with theoretical temperature coefficients attributed to changes in the anode voltages attributable to a calculative temperature rise, thereby correcting individual differences of temperature coefficients of the anode voltages. FIG. 21 is a graph showing that individual differences of anode voltages of the diodes can be corrected by use of the thermistor 17 and a method for applying to the print head, a specified number of times, a drive waveform pulse relating to a voltage at which no ink is ejected.

As is evident from the results of comparison shown in FIGS. 10 and 21, an anode voltage at a certain temperature (e.g., 25° C.) is first specified through comparison between the temperature measured by the thermistor 17 and the anode voltage (P1 in FIG. 21). Second, a drive waveform pulse relating to a voltage at which no ink is to be ejected is applied to the print head a specified number of times, and the magnitude of change in the anode voltages is measured, thereby specifying gradients (temperature coefficients of the anode voltages of the diodes; P2 in FIG. 21).

Accordingly, a threshold value Vc (=analog reference value Va) of the anode voltage of a diode belonging to each head driver IC is determined on the basis of the thus-corrected characteristics of temperature changes in the anode voltages of the diodes. A digital reference value Vd (represented by, e.g., [01001100]) corresponding to the analog reference value Va is sought, and the digital reference value Vd can be input to the reference temperature provider 21. As a result, the temperature of each head driver IC can be measured with the anode voltage of the diode whose individual difference has been corrected with high accuracy.

These correction operations are performed preferably at the time of assembly of an ink jet printer, at the time of first activation of the printer after a user has purchased the printer, or every time power is turned on.

In this case, a digital signal is input to the controller 14 from the head driver ICs 11*a* through 11*d* by way of a single cable 12 provided in the FFC 16. Hence, analog-to-digital conversion of an anode voltage output from the diode 23, which has hitherto been performed, is not required. Hence, provision of an analog-to-digital converter in the controller 14 is obviated. Further, there may also be obviated a necessity for providing signal lines in the FFC 16 for the respective head driver ICs 11*a* through 11*d*. Accordingly, the controller 14 can be constructed in a compact manner and with fewer pins. Further, a line used for temperature detecting may also be embodied by use of a one-core cable to be provided in the FFC 16, thereby enabling cost reduction. These correction operations are performed preferably at the time of assembly of an ink jet printer, at the time of first activation of the printer after a user has purchased the printer, or every time power is turned on.

The anode voltage is subjected to analog-to-digital conversion, and a junction temperature is determined by use of the coefficient determined above. The upper limit anode voltage of the junction temperature is determined from the thus-determined coefficient. A protection measure, such as interruption of printing operation, is taken when the anode voltage has achieved the value.

As mentioned above, the anode voltage is corrected, by matching the result of temperature detected by the thermistor provided on the head board with the temperature corresponding to the anode voltage. A drive waveform at which no ink is to be ejected is applied to the print head, thereby correcting the temperature coefficient of the anode voltage. Hence, the junction temperatures of the head driver ICs can be detected accurately.

Figure 20:
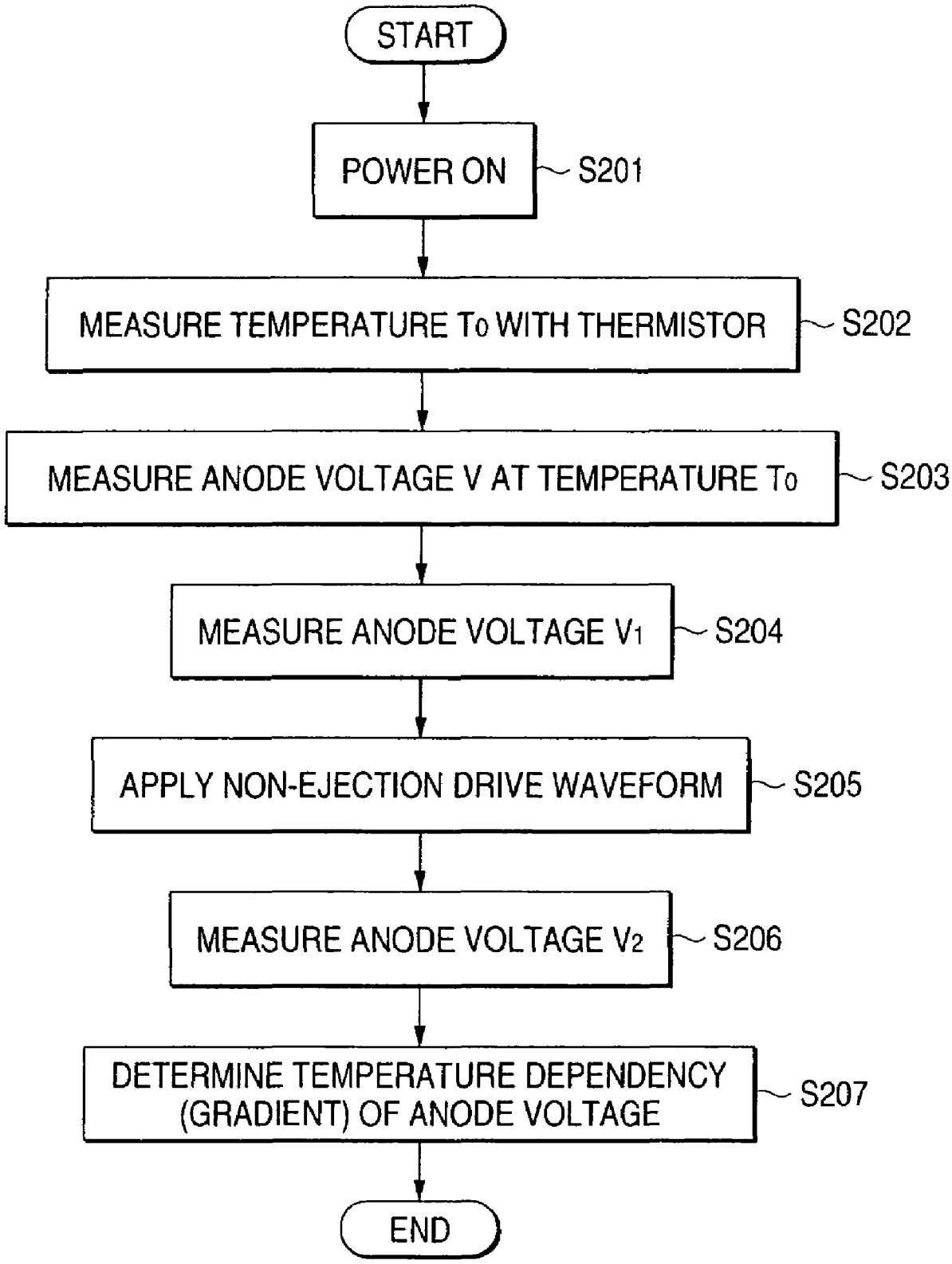
FIG. 20 is a flowchart showing a temperature detecting operation performed in the head driver IC temperature detector shown in FIG. 19.

As shown in FIG. 20, when power is turned on (S201), the head driver IC temperature detector of the embodiment measures an ambient temperature (T0) of the print head by use of the thermistor through correction of individual differences of an anode voltage of the diode (S202). Next, the anode voltage is measured to specify an anode voltage V at the ambient temperature (T0) (S203). The anode voltage is again measured, and the thus-measured anode voltage is taken as V1 (S204). After application to the print head of a given number of drive waveforms at which no ink is to be ejected (S205), the anode voltage is again measured. The anode voltage is taken as V2 (S206). The temperature characteristic (gradient) of the anode voltage is specified on the basis of a calculative temperature change and V1-V2 (S207).

The invention is not limited to the processing depicted in the form of a flowchart shown in FIG. 20. As a matter of course, the invention can be applied to a computer-readable recording medium having the processing recorded thereon and a computer program to be used for executing the processing.

In the above-described embodiments, the invention has been applied to an example wherein digital reference values corresponding to threshold temperatures for respective head driver ICs are set in a reference temperature provider; the digital reference value is converted into an analog reference value by a digital-to-analog converter; the analog reference value is then compared with the anode voltage; and, when the anode voltage has dropped below the reference value, a digital signal is transmitted to a controller of a printer main unit. The invention can also be applied to an example of detecting of the temperature of a related-art head driver IC, wherein an analog signal corresponding to the detected anode voltage is transmitted to the controller of the printer main unit by way of a signal line provided in an FFC, and the signal is subjected to analog-to-digital conversion in the controller of the printer main unit, thereby determining whether the temperature is higher or lower than a threshold temperature.

The storage, such as a memory, may be provided with a table or the like in which temperatures measured by the thermistor and anode voltages are stored so as to correspond to each other. Temperature correction may be performed by reference to this table.

What is claimed is:

1. An ink jet printer, comprising:

a plurality of driver ICs, each of which drives an associated print head, each driver IC including:

an analog voltage provider, which provides an analog voltage which is inversely proportional to a temperature of the driver IC;

a reference temperature provider, which provides a digital value corresponding to a reference temperature;

a D/A converter, which converts the digital value into a corresponding analog value; and a comparator, which compares the analog voltage with the analog value and outputs a comparison signal indicating whether the analog voltage is higher than the analog value; and a temperature detector, which determines whether the temperature of at least one of print heads is higher than the reference temperature in accordance with the comparison signal.

2. The ink jet printer as set forth in claim 1, wherein the comparison signal from each of the driver ICs is inputted to the temperature detector independently from another.

3. The ink jet printer as set forth in claim 1, wherein the driver IC includes an FET in which the comparison signal is inputted to a gate and a drain is left open.

4. The ink jet printer as set forth in claim 3, wherein a digital output signal from the FET in each of the driver ICs is inputted to the temperature detector independently from another.

5. The ink jet printer as set forth in claim 3, wherein an output terminal of the FET in each of the driver ICs is wired-AND connected with another output terminals so that a digital output signal from each FET is transmitted to the temperature detector via a single line.

6. The ink jet printer as set forth in claim 1, wherein the driver IC includes a bipolar transistor in which the comparison signal is inputted to a base and a collector is left open.

7. The ink jet printer as set forth in claim 6, wherein a digital output signal from the bipolar transistor in each of the driver ICs is inputted to the temperature detector independently from another.

8. The ink jet printer as set forth in claim 6, wherein an output terminal of the bipolar transistor in each of the driver ICs is wired-AND connected with another output terminals so that a digital output signal from each bipolar transistor is transmitted to the temperature detector via a single line.

9. The ink jet printer as set forth in claim 1, wherein the reference temperature is determined for each driver IC in accordance with a placement condition of the driver IC.

10. The ink jet printer as set forth in claim 1, further comprising a digital data storage composed of a predetermined number of bit which defines an adjustable range of the digital value.

11. The ink jet printer as set forth in claim 10, further comprising a selector, which selectably varies the digital value of at least one reference temperature provider.

12. The ink jet printer as set forth in claim 11, wherein:

the selector varies the digital value of each reference temperature provider in accordance with a predetermined order, when the comparison signal indicates that the temperature of at least one print head is higher than the reference temperature; and the temperature detector determines that the temperature of one drive IC is higher than the reference temperature when the comparison signal changes in accordance with the variation of the digital signal of the one drive IC.

13. The ink jet printer as set forth in claim 12, wherein the selector minimizes the digital value.

14. The ink jet printer as set forth in claim 11, further comprising a failure detector, which determines that whether at least one of the driver ICs is in a failure, wherein:

the selector varies the digital value of each reference temperature provider in accordance with a predetermined order at a predetermined timing; and the failure detector determines that one drive IC is in a failure when the comparison signal changes in accordance with the variation of the digital signal of the one drive IC.

15. The ink jet printer as set forth in claim 14, wherein the selector maximizes the digital value.

16. The ink jet printer as set forth in claim 14, wherein the predetermined timing is at least one of when the printer is activated, when a printing operation is sustained, when a page break is performed.

17. The ink jet printer as set forth in claim 14, wherein the selector varies the digital value periodically.

18. The ink jet printer as set forth in claim 14, wherein the failure detector determines that there is a failure common to the respective driver ICs when it is determined that all the driver ICs are in a failure.

19. The ink jet printer as set forth in claim 15, wherein:

the selector minimizes the digital values of all the driver ICs collectively, when the comparison signal indicates that the temperature of at least one print head is higher than the reference temperature; and the failure detector determines that at least one of the driver ICs is in a failure when the comparison signal changes in accordance with the minimization.

20. The ink jet printer as set forth in claim 1, wherein the temperature detector determines that a fatal error occurs in the printer when a number of determination that the temperature of the print head is higher than the reference temperature exceeds a predetermined number.

21. The ink jet printer as set forth in claim 1, further comprising:

a thermistor, provided on each print head to detect an ambient temperature of the print head; and a corrector, which corrects the temperature of each print head detected based on the analog voltage, by using the ambient temperature detected by the thermistor.

22. The ink jet printer as set forth in claim 21, further comprising:

a first calculator, which calculates a theoretical temperature dependency of the analog voltage when the print head is driven in a predetermined manner; and a second calculator, which calculates an actual temperature dependency of the analog voltage when the print head is driven in the predetermined manner, wherein the corrector corrects the detected temperature of each print head based on a difference between the theoretical temperature dependency and the actual temperature dependency.

23. The ink jet printer as set forth in claim 22, wherein:

the thermistor detects a first ambient temperature at an initial condition and a second ambient temperature when the print head is driven such an extent that no ink drop is ejected from the nozzle array; and the actual temperature dependency of the analog voltage is determined by measuring a difference between a first analog voltage at the first ambient temperature and a second analog voltage at the second ambient temperature.

24. An ink jet printer, comprising:

a plurality of driver ICs, each of which drives an associated print head, each driver IC including:

an analog voltage provider, which provides an analog voltage corresponding to temperature of the driver IC;

a reference temperature provider, which provides a digital value corresponding to a reference temperature;

a D/A converter, which converts the digital value into a corresponding analog value; and a comparator, which compares the analog voltage with the analog value and outputs a comparison signal indicating whether the analog voltage is higher than the analog value;

a digital data storage, composed of a predetermined number of bit which defines an adjustable range of the digital value;

a selector, which selectably changes the digital value of each reference temperature provider; and a failure detector, which determines that whether at least one of the driver ICs is in a failure, wherein:

the selector selectively varies the digital value of each reference temperature provider in accordance with a predetermined order at a predetermined timing; and the failure detector determines that one drive IC is in a failure when the comparison signal changes in accordance with the variation of the digital signal of the one drive IC.

25. The ink jet printer as set forth in claim 24, wherein the selector maximizes the digital value.

26. The ink jet printer as set forth in claim 24, wherein the predetermined timing is at least one of when the printer is activated, when a printing operation is sustained, when a page break is performed.

27. The ink jet printer as set forth in claim 24, wherein the selector varies the digital value periodically.

28. The ink jet printer as set forth in claim 24, wherein the failure detector determines that there is a failure common to the respective driver ICs when it is determined that all the driver ICs are in a failure.

29. The ink jet printer as set forth in claim 24, further comprising a temperature detector, which determines whether the temperature of at least one of print heads is higher than the reference temperature in accordance with the comparison signal, wherein:

the selector minimizes the digital values of all the driver ICs collectively, when the comparison signal indicates that the temperature of at least one print head is higher than the reference temperature; and the failure detector determines that at least one of the driver ICs is in a failure when the comparison signal changes in accordance with the minimization.

30. A temperature detecting method for an ink jet printer provided with a plurality of driver ICs, each of which drives an associated print head, the method comprising the steps of:

a) providing a digital value corresponding to a reference temperature;

b) converting the digital value into a corresponding analog value;

c) comparing an analog voltage, which is inversely proportional to a temperature of a driver IC, with the analog value;

d) generating a comparison signal indicating whether the analog voltage is higher than the analog value; and e) determining whether the temperature of at least one of print heads is higher than the reference temperature in accordance with the comparison signal, wherein the steps a) to d) of said comparing are performed in each driver Ics, and wherein the method further comprises the steps of:

varying selectively the digital value of at least one driver IC in accordance with a predetermined order, when the the comparison signal indicates that the temperature of at least one print head is higher than the reference temperature; and determining that the temperature of one dive IC is higher than the reference temperature when the comparison signal changes in accordance with the variation of the digital signal of the one drive IC.

31. The temperature detecting method as set forth in claim 30, wherein the reference temperature is determined for each driver IC in accordance with a placement condition of the driver IC.

32. The temperature detecting method as set forth in claim 30, further comprising the step of determining that a fatal error occurs in the printer when a number of determination that the temperature of the print head is higher than the reference temperature exceeds a predetermined number.

33. The temperature detecting method as set forth in claim 30, wherein the digital data is minimized in an adjustable range thereof.

34. The temperature detecting method as set forth in claim 30, further comprising the steps of:

detecting an ambient temperature of the print head; and correcting the temperature of each print head detected based on the analog voltage, by using the detected ambient temperature.

35. A temperature detecting method for an ink jet printer provided with a plurality of driver ICs, each of which drives an associated print head, the method comprising the steps of:

a) providing a digital value corresponding to a reference temperature;

b) converting the digital value into a corresponding analog value;

c)comparing an analog voltage, which is inversely proportional to a temperature of a driver IC, with the analog value;

d) generating a comparison signal indicating whether the analog voltage is higher than the analog value; and e) determining weather the temperature of at least one of print heads is higher than the reference temperature in accordance with the comparison signal, wherein the steps a) to d) of said comparing are performed in each driver ICs, and wherein the method further comprises the steps of:

minimizing collectively the digital values of all the driver ICs in adjustable ranges thereof, when the comparison signal indicates that the temperature of at least one print head is higher than the reference temperature; and determining that at least one of the driver ICs is in a failure when the comparison signal changes in accordance with the minimization.

36. A temperature detecting method for an ink jet printer provided with a plurality of driver ICs, each of which drives an associated print head, the method comprising the steps of:

a) providing a digital value corresponding to a reference temperature;

b) converting the digital value into a corresponding ana1og value;

c) comparing an analog voltage, which is inversely proportiona1 to a temperature of a driver IC, with the analog value;

d) generating a comparison signal indicating whether the analog voltage is higher than the analog value; and e) determining whether the temperature of at least one of print heads is higher than the reference temperature in accordance with the comparison signal, wherein the steps a) to d) of said comparing are performed in each driver ICs, wherein the method -further comprises the steps of:

detecting an ambient temperature of the print head;

correcting the temperature of each print head detected based on the analog voltage, by using the detected ambient temperature;

calculating a theoretical temperature dependency of the analog voltage when the print head is driven in a predetermined manner; and calculating an actual temperature dependency of the analog voltage when the print head is driven in the predetermined manner, and wherein the detected temperature of each print head is corrected based on a difference between the theoretical temperature dependency and the actual temperature dependency.

37. The temperature detecting method as set forth in claim 36, wherein the ambient temperature detecting step including:

detecting a first ambient temperature at an initial condition; and detecting a second ambient temperature when the print head is driven such an extent that no ink drop is ejected from the nozzle array; and wherein the actual temperature dependency of the analog voltage is determined by measuring a difference between a first analog voltage at the first ambient temperature and a second analog voltage at the second ambient temperature.

38. A computer-readable recording medium, which causes a computer to execute the temperature detecting method as set forth in any one of claims 30-32 and 33-37.

39. A failure detecting method for an ink jet printer provided with a plurality of driver ICs, each of which drives an associated print head, the method comprising the steps of:

providing a digital value corresponding to a reference temperature;

converting the digital value into a corresponding analog value;

comparing an analog voltage, which is corresponding to temperature of the driver IC, with the analog value;

generating a comparison signal indicating whether the analog voltage is higher than the analog value;

determining whether the temperature of at least one of print heads is higher than the reference temperature in accordance with the comparison signal;

varying selectively the digital value of at least one driver IC in accordance with a predetermined order at a predetermined timing; and determining that one drive IC is in a failure when the comparison signal changes in accordance with the variation of the digital signal of the one drive IC.

40. The failure detection method as set forth in claim 39, wherein the digital value is maximized in an adjustable range thereof.

41. The failure detection method as set forth in claim 39, wherein the predetermined timing is at least one of when the printer is activated, when a printing operation is sustained, when a page break is performed.

42. The failure detection method as set forth in claim 39, wherein the selector varies the digital value periodically.

43. The failure detection method as set forth in claim 39, wherein the failure detector determines that there is a failure common to the respective driver ICs when it is determined that all the driver ICs are in a failure.

44. The failure detection method as set forth in claim 39, further comprising the steps of:

determining whether the temperature of at least one of print heads is higher than the reference temperature in accordance with the comparison signal;

minimizing the digital values of all the driver ICs collectively, when the comparison signal indicates that the temperature of at least one print head is higher than the reference temperature; and determining that at least one of the driver ICs is in a failure when the comparison signal changes in accordance with the minimization.

45. A computer-readable recording medium, which causes a computer to execute the failure detecting method as set forth in any one of claims 39-44.

46. An ink jet printer, comprising:

a plurality of driver ICs, each of which drives an associated print head, each driver IC comprising:

an analog voltage provider, which provides an analog voltage corresponding to a temperature of the driver IC;

a reference temperature provider, which provides a digital value corresponding to a reference temperature;

a D/A converter, which converts the digital value into a corresponding analog value; and a comparator, which compares the analog voltage with the analog value and outputs a comparison signal indicating whether the analog voltage is higher that the analog value;

a temperature detector, which determines whether the temperature of at least one of print heads is higher than the reference temperature in accordance with the comparison signal;

a digital data storage, composed of a predetermined number of bit which defines an adjustable range of the digital value; and a selector which selectably varies the digital value of at least one reference temperature provider.

47. The ink jet printer as set for the in claim 46, wherein;

the selector varies the digital value of each reference temperature provider in accordance with a predetermined order when the comparison signal indicates that the temperature of at least one print head is higher than the reference temperature; and the temperature detector determines that the temperature of one drive IC is higher than the reference temperature when the comparison signal changes in accordance with the variation of the digital signal of the one drive IC.

48. The ink jet printer as set forth in claim 47 wherein the selector minimizes the digital value.

49. The ink jet printer as set forth in claim 46, wherein the driver IC includes an FET in which the comparison signal is inputted to a gate and a drain is left open.

50. The ink jet printer as set forth in claim 49, wherein a digital output signal from the FET in each of the driver ICs is inputted to the temperature detector independently from another.

51. The ink jet printer as set forth in claim 49, wherein an output terminal of the FET in each of the driver ICs is wired and connected with another output terminal so that a digital output signal from each FET is transmitted to the temperature detector via a signal line.

52. The ink jet printer as set forth in claim 46, wherein the driver IC includes a bipolar transistor in which the comparison signal is inputted to a base and a collector is left open.

53. The ink jet printer as set forth in claim 52, wherein a digital output signal from the bipolar transistor in each of the driver ICs is inputted to the temperature detector independently from another digital output signal.

54. The ink jet printer as set forth in claim 52, wherein an output terminal of the bipolar transistor in each of the driver ICs is wired and connected with another output terminals so that a digital output signal from each bipolar transistor is transmitted to the temperature detector via a single line.

55. A temperature detecting method for an ink jet printer provided with a plurality of driver ICs, each of which drives an associated print head, the method comprising the steps of:

a) providing a digital value corresponding to a reference temperature;

b) converting the digital value into a corresponding analog value;

c) comparing an analog voltage, which is corresponding to a temperature of the driver IC with the analog value:

d) generating a comparing signal indicating whether the analog voltage is higher that the analog value;

e) varying selectively the digital value of at least one driver IC in accordance with a predetermined order when the comparison signal indicates that the temperature of at least one print head is higher than the reference temperature; and f) determining that the temperature of one drive IC is higher than the reference temperature when the comparison signal changes in accordance with the variation of the digital signal of the one drive IC, wherein the steps a) to f) are performed in each driver IC.

56. The temperature detecting method as set forth in claim 55, wherein the digital data is minimized in an adjustable range thereof.

* * * * *